US006704426B2

(12) United States Patent
Croft, III

(10) Patent No.: US 6,704,426 B2
(45) Date of Patent: Mar. 9, 2004

(54) LOUDSPEAKER SYSTEM

(75) Inventor: James J. Croft, III, Poway, CA (US)

(73) Assignee: American Technology Corporation, San Diego, CA (US)

( * ) Notice: Subject to any disclaimer, the term of this patent is extended or adjusted under 35 U.S.C. 154(b) by 312 days.

(21) Appl. No.: 09/753,297

(22) Filed: Jan. 2, 2001

(65) Prior Publication Data

US 2001/0024508 A1 Sep. 27, 2001

Related U.S. Application Data

(63) Continuation-in-part of application No. 09/505,553, filed on Feb. 17, 2000, and a continuation-in-part of application No. 09/260,309, filed on Mar. 2, 1999, now Pat. No. 6,169,811.

(51) Int. Cl.[7] ..... H04R 25/00

(52) U.S. Cl. ..... 381/351; 381/186; 381/163; 381/335; 381/345; 381/349; 381/350; 181/145; 181/156; 181/144

(58) Field of Search ..... 381/335, 186, 381/337, 338, 342, 345, 351, 163, 357, 180, 349, 350, 389, 71.4, 71.7, 146; 181/163, 147, 156, 145, 160, 199, 144

(56) References Cited

U.S. PATENT DOCUMENTS

| | | | | |
|---|---|---|---|---|
| 1,969,704 A | | 8/1934 | D'Alton | 181/31 |
| 2,689,016 A | | 9/1954 | Lang | 181/31 |
| 3,772,466 A | | 11/1973 | Hossbach | 179/116 |
| 4,076,097 A | | 2/1978 | Clarke | 181/147 |
| 4,301,332 A | | 11/1981 | Dusanek | 179/1 E |
| 4,387,275 A | | 6/1983 | Shimada et al. | 179/115.5 |
| 4,549,631 A | | 10/1985 | Bose | 181/155 |
| 4,875,546 A | | 10/1989 | Krnan | 181/160 |
| 5,092,424 A | | 3/1992 | Schreiber et al. | 181/145 |
| 5,731,553 A | | 3/1998 | Ledoux | 181/156 |
| 6,169,811 B1 | * | 1/2001 | Croft, III | |
| 6,389,146 B1 | * | 5/2002 | Croft, III | |

FOREIGN PATENT DOCUMENTS

| | | |
|---|---|---|
| DE | 0 125 625 | 8/1984 |
| JP | 02260910 | 9/1990 |
| WO | PCT/US98/20817 | 10/1998 |

OTHER PUBLICATIONS

"A Bandpass Loudspeaker Enclosure", L.R. Finchman, Presented at the 634d Convention May 15–18, 1979 Los Angeles.

"Augmented Passive–Radiator Loudspeaker System, Part 1*", Thomas L. Clarke.

"The Acoustic Lever Loudspeaker Enclosure*", Earl R. Geddes, AES Fellow.

Speak 32 from GedLee Associates, Copyright 1998.

"Design of Acoustic Lever Loudspeaker Systems, Part One" Alan A. Phillips, AES 109th Convention, Los Angeles, Sep. 22–26, 2000.

* cited by examiner

*Primary Examiner*—Huyen Le
*Assistant Examiner*—Dionne Harvey
(74) *Attorney, Agent, or Firm*—Thorpe North & Western, LLP

(57) ABSTRACT

A bandpass loudspeaker enclosure system including at least one electro-acoustic transducer with a vibratable diaphragm having a first acoustical coupling surface and a second acoustical coupling surface, and at least one differential area passive radiator with three separate acoustical coupling surface areas. The first acoustical coupling surface of the vibratable diaphragm is substantially air coupled through a first enclosure volume to a first of the three separate acoustical coupling surface areas of the at least one differential area passive radiator. A second of the three separate acoustical coupling surface areas of the at least one differential area passive radiator is substantially air coupled through a second chamber to the external environment through a restricted acoustic opening or passive acoustic radiator of predetermined characteristics. A third and largest of the three separate acoustical coupling surface areas of the at least one differential area passive radiator is acoustically coupled to the external environment, and the second acoustical coupling surface of the vibratable diaphragm is acoustically coupled into a third enclosure volume.

33 Claims, 12 Drawing Sheets

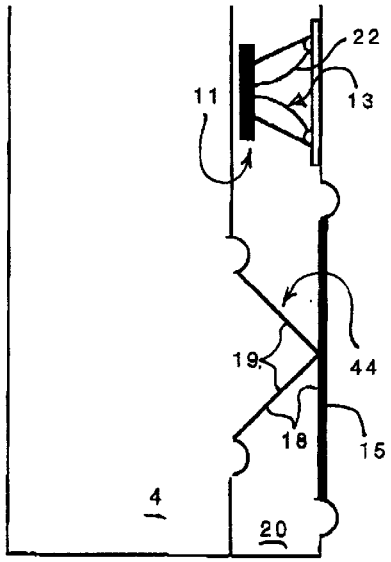
FIG. 1
(Prior Art)
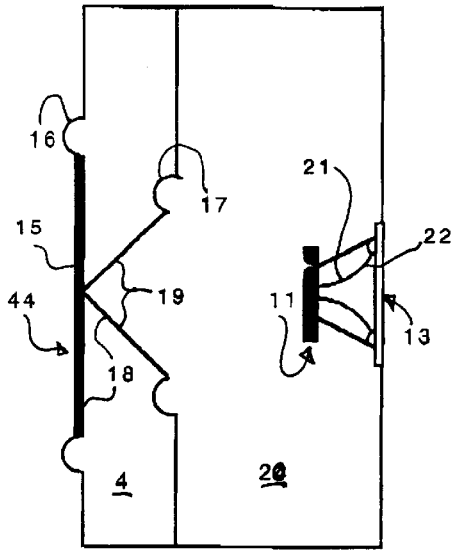
FIG. 2
(Prior Art)
FIG. 3
(Prior Art)
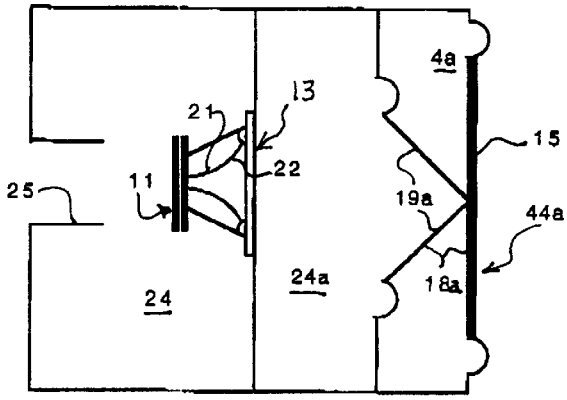
FIG. 4
(Prior Art)
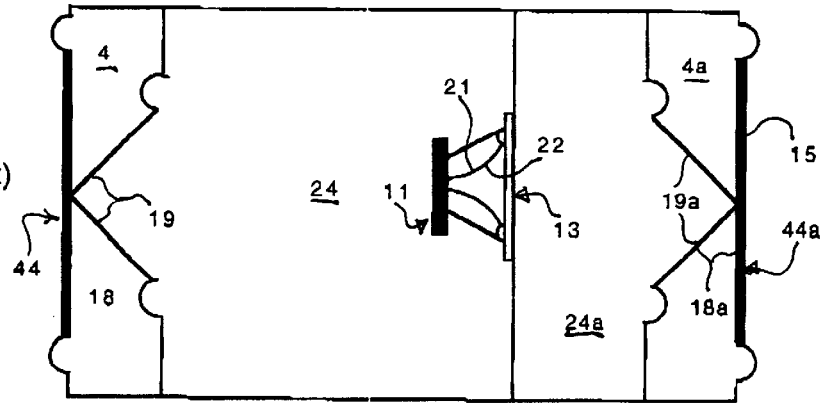

LOUDSPEAKER SYSTEM

This application is a continuation-in-part of U.S. Ser. No. 09/260,309, now U.S. Pat. No. 6,169,811 filed on Mar. 2, 1999 and U.S. patent application Ser. No. 09/505,553 filed Feb. 17, 2000.

BACKGROUND OF THE INVENTION

1. The Field of the Invention

This invention relates to improved loudspeaker systems. In particular the invention relates to improved loudspeaker systems incorporating differential area passive radiators (DAPR) with more than two acoustic surface areas.

2. Prior Art

A group of prior art devices, relating to the invention, include Clarke U.S. Pat. No. 4,076,097, and Dusanek U.S. Pat. No. 4,301,332. These devices are well characterized in "Augmented Passive-Radiator Loudspeaker Systems, Parts 1 and 2" by Thomas L. Clarke, found in the June and July, 1981 issues of the Journal of the Audio Engineering Society.

Another device relating to the invention is found in Geddes PCT WO99/18755. The Geddes device is essentially a bandpass implementation of the Dusanek system. It is characterized in "The Acoustic Lever Loudspeaker Enclosure" found in the January/February 1999 issues of the Journal of the Audio Engineering Society.

These prior art devices configure their active transducers such that one side surface area is coupled through a chamber to one of three diaphragm surface areas of an augmented passive radiator (APR), which is also coupled to the outside environment at a second diaphragm surface area of the APR. An augmented passive radiator is defined as a passive dual cone radiator that has one surface area coupled through the main enclosure volume to the active transducer, a second surface area coupled to the outside environment and a third surface area enclosed in a sealed auxiliary chamber. The Dusanek and Clarke active transducers radiate into free space and the Geddes system operates as a bandpass with the second side of the active transducer coupled to a third internal chamber. Even with this difference all three systems still use the closed architecture approach of exposing only one of the three acoustic surface areas of the augmented passive radiator to the external environment while sealing off the two remaining surface areas into isolated internal chambers or, alternatively, not controlling the output of at least one of the two remaining surface areas through a predetermined opening.

It is also a limitation of these systems that the active transducer has only one side of its cone interacting with the augmented passive radiator and/or they also isolate the output of one of the surface areas of their augmented passive radiators into a sealed chamber so that only one surface area can generate acoustic output. To state it differently, an augmented passive radiator (or the equivalent acoustic lever as per Geddes) is a closed architecture system with an isolated auxiliary chamber that closes off the output and coupling of one of the two smaller coupling areas of the augmented passive radiator. The prior art closed architecture approaches limit the low frequency output capability and/or require a larger enclosure than the present invention.

A further limitation of the Geddes disclosure is that it only discloses the use of an augmented passive radiator in a series bandpass configuration which can be less favorable particularly for low transformation ratio alignments.

SUMMARY OF THE INVENTION

The present invention provides an enhanced acoustic output through the use of an open architecture application of a differential area passive radiator (hereafter referred to as DAPR) having three substantially separate acoustic surface areas. A large or primary acoustic surface area, a smaller or unitary surface area, and a second smaller or differential surface area. The DAPR can be realized with the combination of two loudspeaker cones of different sizes attached back to back, each having their own surround/suspension. Alternatively the DAPR can be realized with one loudspeaker cone with a surround/suspension at the large end of the cone opening and another surround/suspension at the small end of the cone opening. The front and/or the rear of the DAPR is blocked off to acoustically isolate the areas. The DAPR enhances the output of an active transducer by operating as an acoustic transformer with a coupling ratio of the active transducer diaphragm area to the coupled acoustic surface area of the DAPR and the further ratio of one of the smaller acoustic surface areas of the DAPR to the largest surface area of the DAPR.

As disclosed in the parent case this invention advances the art of low frequency output with a three surface area differential area passive radiator in a novel configuration to eliminate the limitations of a closed architecture augmented passive radiator or acoustic lever by using an open architecture configuration of one or more differential area passive radiators.

It was shown that the open architecture is created by using a differential area passive radiator that has at least two of its three surface areas coupled to both sides of the active transducer and/or has a first and largest of the differential area passive radiator's three surface areas output coupled into the listening environment either directly or indirectly through an opening of predetermined characteristics or passive acoustic radiator and a second of the differential area passive radiator's three surface areas at least partially coupled into the listening indirectly through a passive acoustic radiator or opening of predetermined characteristics.

The differential area passive radiator can provide excellent acoustic performance when more than one of its acoustic surfaces has a predetermined, at least partially open, pathway to the external environment.

Further disclosed in the parent cases of this invention is the use of a parallel transfer of acoustic energy with the active transducer coupling acoustically in parallel with the differential area passive radiator by being coupled to the differential coupling area of the DAPR as an alternative to coupling in series through the small or unitary diaphragm surface area of the differential area passive radiator. This parallel coupling can offer favorable construction advantages for a given set of alignments, particularly those with a DAPR transformation ratio of less than two to one.

BRIEF DESCRIPTION OF THE DRAWINGS

FIG. 1 shows a graphic representation of a prior art full range speaker with an augmented passive radiator as a vent/port substitute.

FIG. 2 shows graphic representation of another prior art full range speaker with an augmented passive radiator as a vent/port substitute.

FIG. 3 shows a graphic representation of a bandpass implementation of an augmented passive radiator.

FIG. 4 shows a graphic representation of a bandpass implementation with two augmented passive radiators.

DETAILED DESCRIPTION

Figure 5A:
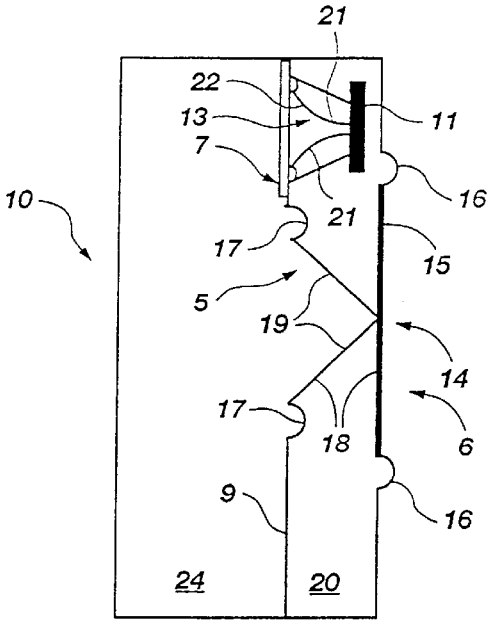
FIG. 5A shows a graphic representation of a basic form of the invention in parallel interaction mode.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

FIG. 1 shows the type of prior art system disclosed in U.S. Pat. No. 4,076,097, granted to Clarke, using an augmented passive radiator. Enclosure 10 contains sub enclosure volumes 4 and 20 and active transducer 11. Contained between the volumes is an augmented passive radiator 44 with two different diaphragm areas, a larger one 15 and a smaller one 19 mechanically coupled together and with active transducer 11 interacting with the difference area 18 of augmented passive radiator 44. As can be seen, the surface area 19 of augmented passive radiator 44 is isolated in auxiliary volume 4 and therefore cannot be coupled to the diaphragm 13 of transducer 11 and cannot contribute acoustic output to the system and is limited by the stiffness of auxiliary volume 4.

FIG. 2 shows the type of prior art system disclosed in U.S. Pat. No. 4,301,332, granted to Dusanek, that performs substantially the same as the one in FIG. 1 with the main difference being that transducer 11 is coupled to in series to the small diaphragm surface area 19 of augmented passive radiator 44. Both of the systems in FIGS. 1 and 2 are full range systems and do not exhibit or teach an acoustic bandpass characteristic. Also, their use of the augmented passive radiator is implemented in a closed architecture with the third undriven, non-radiating diaphragm area (18 in FIG. 2) enclosed in an auxiliary volume 4 and cannot contribute to system output or be relieved of the stiffness in volume 4. This diaphragm area 18 is also isolated from the electro-acoustic transducer. This same limitation is exhibited in the device of FIG. 3 except it is the smaller diaphragm 19 of the augmented passive radiator 44 that is isolated in the sealed stiffness auxiliary chamber 4.

FIG. 3 shows the type of system disclosed in Geddes PCT WO99/18755 can be viewed as a series bandpass version of the augmented passive radiator system. Enclosure 10 contains sub enclosure volumes 4, 24 and 24*a* and active transducer 11. Contained between the volumes is an augmented passive radiator 44*a* with two different diaphragm areas, a larger one 15 and a smaller one 19*a* mechanically coupled together and with active transducer 11 interacting with the small diaphragm area 19*a* of augmented passive radiator 44*a*. Relative to the present and parent patent applications, it can be seen, the surface area 18*a* of augmented passive radiator 44 is isolated in closed auxiliary volume 4*a* and therefore cannot be coupled to either side 21 or 22 of the diaphragm 13 of transducer 11 and also cannot contribute to the acoustic output the system. Also, because of the sealed off nature of the closed architecture, the chamber air stiffness requires that the volume be substantial to achieve reasonable performance. Port 25 enhances output from diaphragm side 21 of transducer 11 but does not enhance output from diaphragm areas 18 or 19*a* of augmented passive radiator 44*a*.

FIG. 4 is essentially the system of FIG. 3 with port 25 replaced with augmented passive radiator 44 which operationally duplicates the function of augmented passive radiator 44 of FIG. 2. It is shown here again that subchamber 4 isolates diaphragm 18 from diaphragm side 21 of transducer 11 and also isolates diaphragm 18 in a sealed off relationship from the external environment.

FIGS. 5A to 6B show basic forms of the invention as disclosed in the parent patent.

FIG. 5A is bandpass loudspeaker enclosure system 10 incorporating primary enclosure volume 20 and primary enclosure volume 24 with a dividing wall 9 positioned between the two primary enclosure volumes. An electro-acoustic transducer 11 is mounted in an opening 7 on dividing wall 9 and includes movable diaphragm 13 which has a surface area side 21 and a surface area side 22. Surface area side 21 of movable diaphragm 13 communicates into primary enclosure volume 20 and surface area side 22 of movable diaphragm 13 communicates into said primary enclosure volume 24. There is a differential area passive radiator 14 that is comprised of large, primary diaphragm surface area 15 and two secondary diaphragm surface areas smaller in acoustic coupling area than primary diaphragm surface area 15. The secondary diaphragm surface areas include a small or unitary diaphragm surface area 19 and a differential diaphragm surface area 18. The primary diaphragm surface area 15 and the unitary diaphragm surface area 19 interconnect and include peripheral attachment means 16 and 17. The differential diaphragm surface area 18 is defined by the differential surface area established between primary diaphragm surface area peripheral attachment means 16 and unitary diaphragm surface area peripheral attachment means 17.

Unitary diaphragm surface area 19 of differential area passive radiator 14 is mounted by peripheral attachment means 17 in opening 5 between the two primary enclosure volumes 20 and 24. Surface area side 21 of electro-acoustic transducer 11 is pneumatically coupled through the primary enclosure volume 20 to differential diaphragm surface area 18 of differential area passive radiator 14. Surface area side 22 of electro-acoustical transducer 11 is pneumatically coupled through enclosure volume 24 to unitary diaphragm surface area 19 of differential area passive radiator 14.

The primary diaphragm surface area 15 of differential area passive radiator 14 is mounted by peripheral attachment means 16 in opening 6 in primary enclosure volume 20. The primary diaphragm surface area 15 of differential area passive radiator 14 communicates from the opening in primary enclosure volume 20 to a region outside of the two primary enclosure volumes.

In this embodiment, particularly when the volume of primary enclosure volume 20 is smaller than that of primary enclosure volume 24, the active electro-acoustic transducer 11 and its diaphragm 13 form a bass reflex mode at a frequency near the upper range of the system by interacting with the differential area 18 of the differential area passive radiator 14. At all lower frequencies active electro-acoustic transducer 11 and differential area passive radiator 14 are firmly air coupled together and operate in phase. The active transducer drives the differential area passive radiator in a parallel relationship and therefore this is considered the parallel interaction version of the invention. The volume displacement of the system is magnified by the ratio of the diaphragm area of transducer 11 and the diaphragm area of differential diaphragm 18 of differential area passive radiator 14. If the diaphragm 13 is greater in area than differential surface area 18 then this ratio magnifies the displacement of transducer 11 to a greater displacement in differential area passive radiator 14. The acoustic volume displacement of the system is further magnified by the ratio of the diaphragm area of transducer 11 and the diaphragm area of diaphragm 15 of differential area passive radiator 14.

Figure 5B:
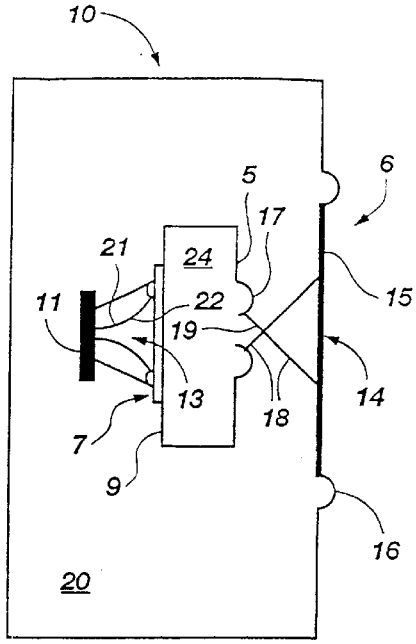
FIG. 5B shows a graphic representation of a basic form of the invention in series interaction mode.

FIG. 5B shows another form of the invention that is considered the series interaction version of the invention. Shown is bandpass loudspeaker enclosure system 10 incorporating primary enclosure volume 20 and primary enclosure volume 24 with dividing wall 9 positioned between the two primary enclosure volumes. An electro-acoustic transducer 11 is mounted in opening 7 on dividing wall 9 and includes movable diaphragm 13 which has a surface area side 21 and a surface area side 22. Surface area side 21 of movable diaphragm 13 communicates into primary enclosure volume 20 and surface area side 22 of movable diaphragm 13 communicates into primary enclosure volume 24.

Included is differential area passive radiator 14 that is comprised of primary diaphragm surface area 15 and two secondary diaphragm surface areas smaller in acoustic coupling area than said primary diaphragm surface area 15. The secondary diaphragm surface areas include unitary diaphragm surface area 19 and differential diaphragm surface area 18. The primary diaphragm surface area 15 and unitary diaphragm surface area 19 interconnect and include peripheral attachment means 16 and 17. The differential diaphragm surface area 18 is defined by the differential surface area established between primary diaphragm surface area peripheral attachment means 16 and secondary diaphragm surface area peripheral attachment means 17.

The small (or unitary) diaphragm surface area 19 of the DAPR 14 is mounted by peripheral attachment means 17 in opening 5 between the two primary enclosure volumes 20 and 24. The surface area side 21 of the electro-acoustic transducer 11 is pneumatically coupled through primary enclosure volume 20 to differential diaphragm surface area 18 of differential area passive radiator 14. The surface area side 22 of the electro-acoustical transducer 11 is pneumatically coupled through primary enclosure volume 24 to unitary diaphragm surface area 19 of differential area passive radiator 14. The primary diaphragm surface area 15 of differential area passive radiator 14 is mounted by peripheral attachment means 16 in opening 6 in primary enclosure volume 20. The primary diaphragm surface area 15 of DAPR 14 communicates from the opening in primary enclosure volume 20 to a region outside of the two primary enclosure volumes.

In this embodiment, particularly when the volume of primary enclosure volume 24 is smaller than that of primary enclosure volume 20, the driving force of the active electro-acoustic transducer 11 and its diaphragm 13 interact to couple with the smaller diaphragm area 19 of the differential area passive radiator 14 and therefore at low frequencies active electro-acoustic transducer 11 and differential area passive radiator 14 operate in phase. The active transducer drives the differential area passive radiator in a serial relationship and therefore this is considered the series interaction version of the invention. The output of the active transducer 11 is magnified to substantially the same extent as the device in FIG. 5A assuming that the diaphragm area of differential diaphragm area 18 in FIG. 5A is the same effective surface area as the diaphragm area of unitary diaphragm area 19 of FIG. 5B and the diaphragm area 13 is the same in both FIGS. 5A and 5B.

Any embodiments of the invention that use a form of passive acoustic energy radiator may borrow from the group that is known in the industry that include but are not limited to, vent openings, extended port tubes or suspended passive diaphragms. An augmented passive radiator, DAPR, or two suspended passive diaphragms connected back to back with an auxiliary chamber, may also be used as the passive acoustic energy radiator.

Figure 6A:
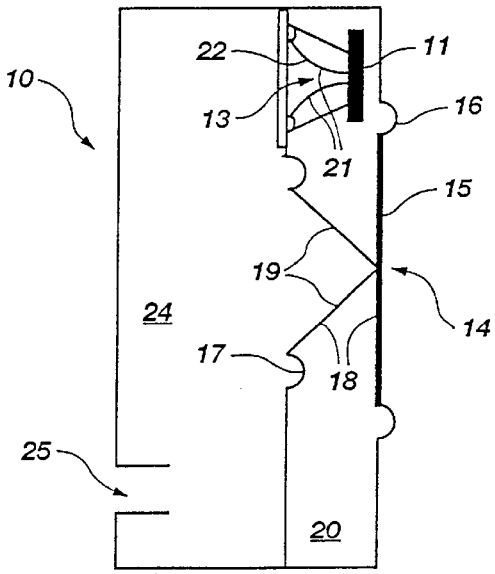
FIG. 6A shows a graphic representation of a basic form of the invention with a vent.

FIG. 6A is the bandpass loudspeaker enclosure system of FIG. 5A further including a passive acoustic energy radiator 25, expressed here as an elongated port, communicating from the interior to the outside of primary enclosure volume 24. With this embodiment the open architecture of the differential area passive radiator 14 contributes significant increases in output. At the lowest frequencies reproduced by the system the open, shared volume 24 allows the surface area 22 of diaphragm 13 of transducer 11 to sum together with surface area 19 of differential area passive radiator 14 to deliver very high acoustic output through passive acoustic energy radiator 25.

Figure 6B:
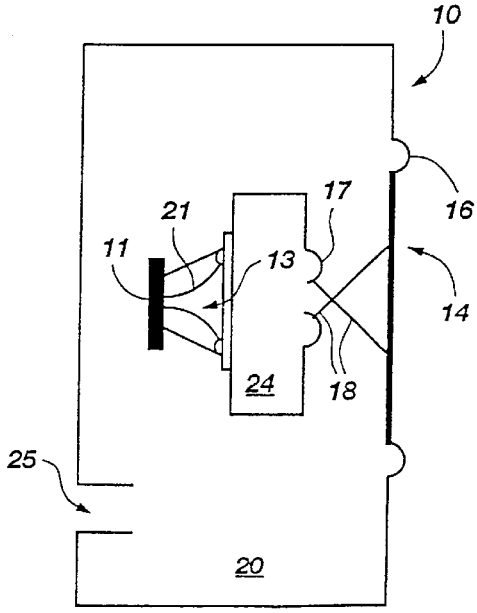
FIG. 6B shows a graphic representation of another basic form of the invention with a vent.

FIG. 6B is the bandpass loudspeaker enclosure system of FIG. 5B further including a passive acoustic energy radiator 25, expressed here as an elongated port, communicating from the interior to the exterior of primary enclosure volume 20. With this embodiment the open architecture of the differential area passive radiator 14 contributes significant increases in output. At the lowest frequencies reproduced by the system the open, shared volume 20 allows the surface area 21 of diaphragm 13 of transducer 11 to sum together with differential diaphragm surface area 18 of differential area passive radiator 14 to deliver very high acoustic output through passive acoustic energy radiator 25.

An example of the parameters for a system of FIG. 6B reduced to practice is as follows: Specifications for a system as shown in FIG. 6B

| Electro-acoustic transducer 11 parameters | |
|---|---|
| Diaphragm 13 diameter: | 6.5" |
| Free air resonance: | 45 Hz |
| Moving mass: | 0.03 kg |
| DC resistance: | 6.2 ohms |
| Qes: | .27 |
| Qms: | 6.5 |
| Passive elements | |
| Differential Area Passive Radiator unitary diaphragm diameter 19: | 6.5" |
| Differential Area Passive Radiator Primary diaphragm diameter: | 8.0" |
| Primary Enclosure Volume 20: | 2670 cubic inches |
| Primary Enclosure Volume 24: | 130 cubic inches |
| Diameter of port 25: | 4" |
| Length of port 25: | 15" |
| Differential Area Passive Radiator 14 mass: | 0.070 Kg |
| Differential Area Passive Radiator 14 free air resonance: | 40 Hz |

These general parameters can be applied as a starting point for all the various inventive embodiments disclosed.

FIGS. 7A, 7B, 8*a* and 8*b* show more forms of the invention expressed in the parent cases.

Figure 7A:
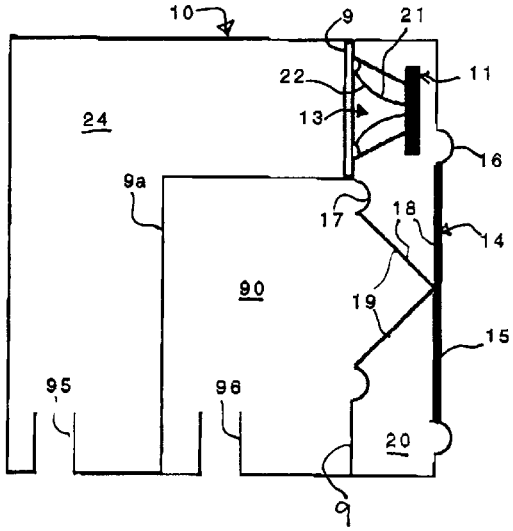
FIG. 7A shows a graphic representation of the invention with the transducer coupled to a chamber which is coupled to a passive acoustic radiator and one surface of the differential area passive radiator coupled to a second chamber which is coupled to a passive acoustic radiator.

FIG. 7A shows a bandpass loudspeaker enclosure system 10 incorporating primary enclosure volume 20, primary enclosure volume 24 and primary enclosure volume 90. A dividing wall 9 is positioned between primary enclosure volumes 20 and 24 and in this embodiment divides chambers or primary enclosure volumes 20 and 90. Dividing wall 9*a* isolates chamber 90 from chamber or primary enclosure volume 24. An electro-acoustic transducer 11 is mounted on dividing wall 9 and includes movable diaphragm 13 having a surface area side 21 and a surface area side 22. The surface area side 21 of movable diaphragm communicates into primary enclosure volume 20 and surface area side 22 of the movable diaphragm 13 communicates into primary enclosure volume 24. A differential area passive radiator 14 includes primary diaphragm surface area 15 and two secondary diaphragm surface areas, both smaller in acoustic coupling area than the primary diaphragm surface area 15. The secondary diaphragm surface areas include a unitary diaphragm surface area 19 and a differential diaphragm surface area 18. The primary diaphragm surface area 15 and unitary diaphragm surface area 19 are interconnected and include peripheral attachment means 16 and 17.

The differential diaphragm surface area 18 is defined by the differential surface area established between the primary diaphragm surface area peripheral attachment means 16 and unitary diaphragm surface area peripheral attachment means 17. The surface area 21 of the electro-acoustic transducer 11 is pneumatically coupled through primary enclosure volume 20 to differential diaphragm surface area 18 of differential area passive radiator 14. The surface area side 22 of the electro-acoustical transducer 11 is pneumatically coupled through primary enclosure volume 24 to passive acoustic energy radiator 95 which communicates from the interior to the exterior of primary enclosure volume 24. The passive acoustic radiator 95 is shown here as a port. Unitary diaphragm surface area 19 of differential area passive radiator 14 is pneumatically coupled through primary enclosure volume 90 to passive acoustic energy radiator 96 which communicates from the interior to the exterior of primary enclosure volume 90. Passive acoustic radiator 96 is shown here as a port. The primary diaphragm surface area 15 of differential area passive radiator 14 communicates to a region outside of primary enclosure volumes 20, 24 and 90.

Another, simplified, description of FIG. 7A is that of a bandpass loudspeaker enclosure system 10 with a transducer 11 operating in a parallel relationship to a differential area passive radiator. The bandpass loudspeaker system 10 includes:

a) at least one electro-acoustic transducer 11 with a vibratable diaphragm 13 having a first acoustical coupling surface 21 and a second acoustical coupling surface 22;

b) at least one differential area passive radiator 14 with three separate acoustical coupling surface areas, the largest, primary acoustical coupling surface area 15, the differential area acoustical coupling surface area 18, and the small unitary acoustical coupling surface area 19;

c) the first acoustical coupling surface 21 of the said vibratable diaphragm 13 substantially air coupled through a first enclosure volume 20 to a first of the three separate acoustical coupling surface areas, here in the parallel case, differential surface area 18 of said at least one differential area passive radiator 14;

d) a second of the three separate acoustical coupling surface areas, small unitary surface area 19 of said at least one differential area passive radiator 14 being substantially air coupled through a second chamber 90 to the external environment through an acoustic opening of predetermined dimensions or passive acoustic radiator of predetermined characteristics 96. Opening 96 is shown here as an elongated port but can be of any passive acoustic radiator construction known in the art including those in FIGS. 9A to 9G; and e) a third and largest of the three separate acoustical coupling surface areas, large primary acoustical coupling area 15 of said at least one differential area passive radiator 14 acoustically coupled to the external environment;

f) said second acoustical coupling surface of the said vibratable diaphragm substantially air coupled into a third enclosure volume 24. Passive acoustic radiator 95, shown here as an elongated port couples the output of side 22 of diaphragm 13 to the external environment. Passive acoustic radiator 95 can be of any passive acoustic radiator construction known in the art including those in FIGS. 9*a* to 9*g*.

In this 7A embodiment the inventive structure uses the active electroacoustic transducer 11 to drive the differential surface area diaphragm 18 throughout the passband of the system with the ratio of the area of differential diaphragm area 18 to the area of the large or primary diaphragm area 15 being a step up ratio of the system causing an acoustical transformation of the acoustical output of electroacoustical transducer 11. A further acoustic transformation is caused by the diaphragm area ratio of the acoustic surface area transducer diaphragm 13 to acoustic diaphragm surface area of differential surface area 18 of differential area passive radiator 14. The transducer is also coupled into chamber 24 which is tuned to a bass reflex resonant frequency determined by the compliance of chamber 24 resonating with the acoustic mass of passive acoustic radiator 95. This can reduce the required diaphragm displacement of transducer 11 while increasing acoustic output of the system at this reflex tuning frequency.

The small or unitary diaphragm surface area 19 of differential area passive radiator 14 is coupled into chamber 90 and which has a bass reflex resonant frequency determined by the acoustic compliance of chamber 90 resonating with the acoustic mass of passive acoustic radiator 96. If tuned to a frequency at or below the bandpass of the system, this open architecture approach can reduce diaphragm displacement of both the electroacoustic transducer 11 and differential area passive radiator 14 while increasing total system acoustic output at the reflex tuning frequency. Another approach to using the open architecture of chamber 90 through passive acoustic radiator 96 is to tune the mass and compliance of radiator 96 and chamber 90 to a higher frequency either in the upper end of the system passband or the above the passband, in the upper stop band of the system. By doing this the size of chamber 90 may be substantially reduced with a small impact on system performance. Opening 96 may also be constructed to have the predetermined characteristic of increased acoustic resistance. This increased acoustic resistance can damp the reflex tuning to minimize any aberrations in the upper band frequency response and contribute to minimizing acoustic cancellation of the output from diaphragm surface area 19 and diaphragm surface area 15. A version of FIG. 7A with acoustic resistance in passive acoustic radiator 96 is schematically illustrated with passive acoustic radiator 96*a* in FIG. 11C.

The parallel structure of FIG. 7A may be preferred when the differential area passive radiator ratio is less than two to one due to lower DAPR mass for all ratios less than two to one. When the differential area passive radiator ratio is greater than two to one then the series version of FIG. 7A, shown in FIG. 7B may be preferred due to lower DAPR mass for all ratios greater than two to one.

Figure 7B:
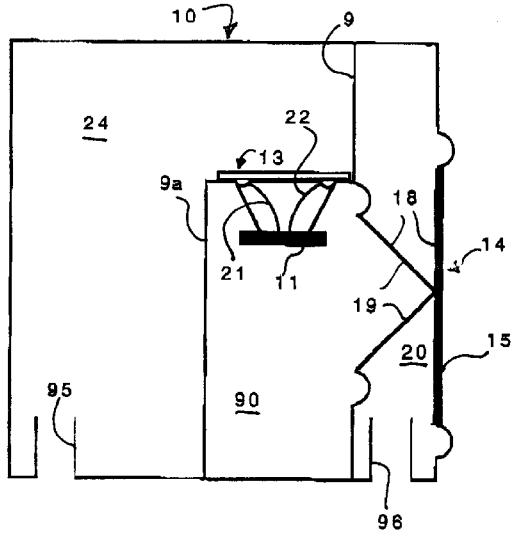
FIG. 7B shows a graphic representation of the invention with an alternative series construction to the system in FIG. 7A.

FIG. 7B shows an equivalent but alternative version of the embodiment of FIG. 7A with transducer 11 operating in a series relationship with differential area passive radiator 14. Shown is bandpass loudspeaker system 10 including:

a) at least one electro-acoustic transducer 11 with a vibratable diaphragm 13 having a first acoustical coupling surface 21 and a second acoustical coupling surface 22;

b) at least one differential area passive radiator 14 with three separate acoustical coupling surface areas, the largest, large primary acoustical coupling surface area 15, the differential area acoustical coupling surface area 18, and the small unitary acoustical coupling surface area 19;

c) the first acoustical coupling surface 21 of the said vibratable diaphragm 13 being substantially air coupled through a first enclosure volume 90 to a first of the three separate acoustical coupling surface areas, small unitary surface area 19 of said at least one differential area passive radiator 14;

d) a second of the three separate acoustical coupling surface areas, differential surface area 18 of said at least one differential area passive radiator 14 is substantially air coupled through a second chamber 20 to the external environment through an acoustic opening of predetermined dimensions or passive acoustic radiator of predetermined characteristics 96. Passive acoustic radiator 96 is shown here as an elongated port but can be of any passive acoustic radiator construction known in the art including those in FIGS. 9*a* to 9*g;* and e) a third and largest of the three separate acoustical coupling surface areas, primary surface area 15 of said at least one differential area passive radiator 14 acoustically coupled to the external environment;

f) said second acoustical coupling surface 22 of the said vibratable diaphragm being substantially air coupled into a third enclosure volume 24. Restricted acoustic opening or passive acoustic radiator 95, shown here as an elongated port, couples the output of side 22 of diaphragm 13 to the external environment. Passive acoustic radiator 95 can be of any passive acoustic radiator construction known in the art including those in FIGS. 9*a* to 9*g*.

All of the attributes of this embodiment are essentially the same as that of FIG. 7A except for the preference of this series configuration being preferable in systems using greater than two to one DAPR transformation ratios.

Various restricted openings or portals are known in the art of loudspeakers. These acoustic openings or portals for this invention are of predetermined dimensions and are at least partially acoustically transparent relating to frequency and/or attenuation depending on their characteristics of acoustic mass, acoustic resistance and in some cases compliance. They are generally known as passive acoustic radiators and have been well developed in various forms.

Figure 8A:
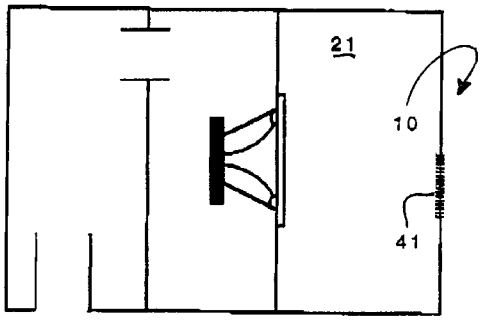
FIG. 8A shows a graphic representation of an embodiment of a woofer system with a highly resistive vent.

As disclosed in FIG. 9 of parent application No.-553, FIG. 8*a* shows a speaker configuration 10 having a resistive opening 41 that may exist from a subchamber 21 as when the subchamber is not perfectly sealed. This resistive opening is generally understood by those skilled in the art to be a passive acoustic radiator with a predetermined characteristic of acoustic resistance. In some system alignments, the resistive leakage may be used to achieve resistive damping to the diaphragm enclosed in the subchamber. This is particularly useful if a transducer is used that exhibits an underdamped characteristic or has output that is desired to be attenuated but not totally sealed off from an external environment.

In any of the disclosed systems a subchamber may have a predetermined leakage to the region outside the enclosure with the leakage characterized as an acoustic resistance. This approach can be optimized by use of a predetermined acoustic resistance.

Figure 8B:
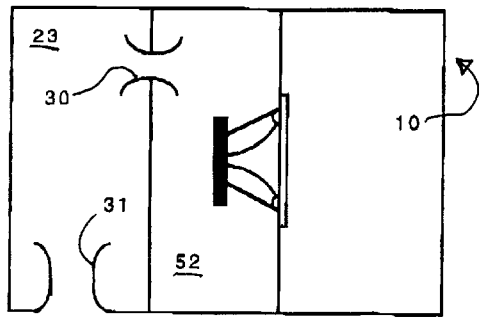
FIG. 8B shows a graphic representation of an embodiment of a woofer system low resistance, flared vents.

As disclosed in FIG. 6 of parent application No.-553, FIG. 8*b* shows a speaker configuration 10 having a flared port 31 exiting from chamber 23 of enclosure 10. A second flared port 30 is used to intercouple chambers 22 and 23. Flared ports of this type can be used where ever a passive acoustic radiator is specified and can offer the advantages of lower resistive losses, reduced air turbulence and noise.

Various restricted openings or portals are known in the art of loudspeakers. In this invention it would be important to have any of these openings be of predetermined dimensions. These acoustic openings or portals are at least partially acoustically transparent relating to frequency and/or attenuation depending on their characteristics of acoustic mass, acoustic resistance and in some cases compliance. They are generally known as passive acoustic radiators and have been well developed in various forms. Some of the most commonly know are illustrated in FIGS. 9A to 9G.

Figure 9A:
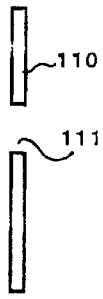
FIG. 9A shows a graphic representation of a passive acoustic radiator illustrated as a vent opening.
Figure 9B:
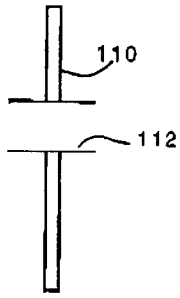
FIG. 9B shows a graphic representation of a passive acoustic radiator illustrated as an extended port.

FIG. 9A shows an opening 111 through a wall or partition 110 that represents prior art passive acoustic radiator commonly referred to as a vent. This would be considered an opening of predetermined dimensions with a characteristic acoustic mass. FIG. 9B shows an elongated pipe 112 mounted through a wall or partition 110 that represents prior art passive acoustic radiator commonly referred to as a port. The terms port and vent are generally used interchangeably in the art.

Figure 9C:
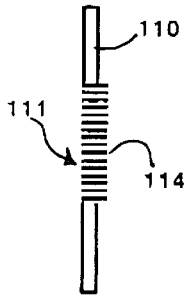
FIG. 9C shows a graphic representation of a passive acoustic radiator illustrated as an lossy resistive vent.
Figure 9D:
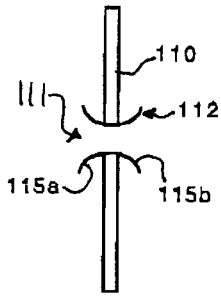
FIG. 9D shows a graphic representation of a passive acoustic radiator illustrated as a low loss extended port.

FIG. 9C illustrates an acoustically lossy version of a vent or port opening. As it is known in the art all ports and vents have the characteristic of acoustic mass and acoustic resistance. Acoustic mass is increased by reducing the diameter of a vent/port and/or increasing the length of the vent/port. As it is commonly known in the art, acoustic resistance is increased by introducing an acoustically lossy medium 114 in the opening 111 in partition 110 by reducing the diameter of the vent/port, having an increased number of small diameter vent/ports or to restrict the airflow through a vent/port opening with an acoustically resistive material such as felt, cellular foam, fiberglass or other materials known in the art for acoustic resistance. FIG. 9D shows another embodiment of an elongated pipe 12 having a low loss port opening 111 in partition 110 with flared openings 115*a* and 115*b*. As it is known in the art flared openings can be used to create a lower loss, lower noise port by minimizing ingress and egress turbulence.

Figure 9E:
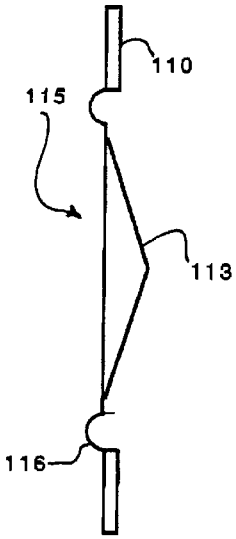
FIG. 9E shows a graphic representation of a passive acoustic radiator illustrated as a suspended passive diaphragm.

FIG. 9E shows an opening 115 in a wall or partition 110 that has a passive suspended radiator 113 mounted in the opening 115 suspended by surround/suspension 116 and represents prior art passive acoustic radiator called a passive radiator or passive suspended radiator. In addition to the characteristics of acoustic mass and acoustic resistance that are embodied in other passive acoustic radiators, this passive acoustic radiator also includes the characteristic of compliance.

Figure 9F:
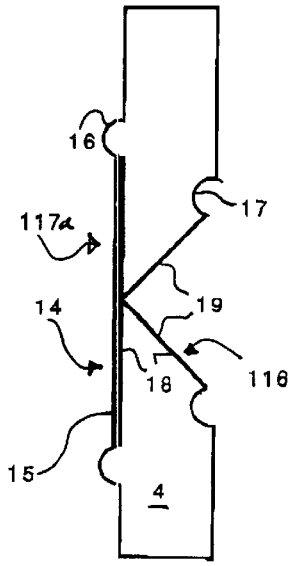
FIG. 9F shows a graphic representation of a passive acoustic radiator illustrated as a series augmented passive radiator.

FIG. 9F shows an auxiliary enclosure volume 4 with a differential area passive radiator 14 mounted in an opening 118 in the auxiliary enclosure volume. This represents a series augmented passive radiator wherein a small or unitary diaphragm surface area 19 would be acoustically coupled to the output from an electroacoustic transducer (not shown). See prior art FIG. 2. The large or primary diaphragm surface area 15 is usually coupled to the external environment and the differential diaphragm surface area 18 is coupled into and isolated in an auxiliary subchamber 4.

Figure 9G:
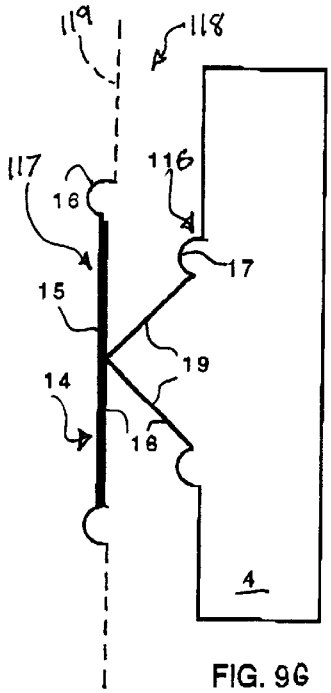
FIG. 9G shows a graphic representation of a passive acoustic radiator illustrated as a second type of parallel augmented passive radiator.

FIG. 9G shows an auxiliary enclosure volume 4 with a differential area passive radiator 14 mounted in two different openings 116 and 117 in the auxiliary enclosure volume 4. This represents a parallel augmented passive radiator wherein the differential diaphragm surface area 18 would be acoustically coupled to the output from an electroacoustic transducer. See prior art FIG. 1. The large or primary diaphragm surface area 15 is usually coupled to the external environment and the small or unitary diaphragm surface area 19 is coupled into and isolated in an auxiliary subchamber 4.

Any of the embodiments of known passive acoustic radiators, including those shown in FIGS. 9A through 9G, may be interchanged within the embodiments disclosed herein where ever a passive acoustic radiator is specified.

Figure 10A:
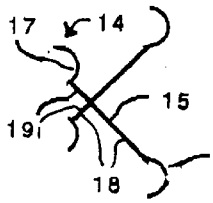
FIG. 10A illustrates a graphic representation of a construction of the differential area passive radiator.

FIG. 10A shows a construction of a differential area passive radiator 14 that is comprised of the largest, primary diaphragm surface area 15 and two secondary diaphragm surface areas 18 and 19 smaller in acoustic coupling area than primary diaphragm surface area 15. The secondary diaphragm surface areas include a small, unitary diaphragm surface area 19 and a differential diaphragm surface area 18. The primary diaphragm surface area 15 and the unitary diaphragm surface area 19 interconnect and each include peripheral attachment means 16 and 17. The differential diaphragm surface area 18 is defined by the differential surface area established between the primary diaphragm surface area peripheral attachment means 16 and the unitary diaphragm surface area peripheral attachment means 17. In most constructions, the effective acoustic area of the different diaphragm surface area 18 is usually calculated by subtracting the small unitary diaphragm surface area 19 from the large primary diaphragm surface area 15.

Figure 10B:
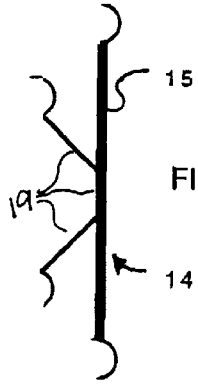
FIG. 10B illustrates a graphic representation of a construction variation of the differential area passive radiator.

FIG. 10B shows a construction of a differential area passive radiator 14, where the large primary diaphragm area 15 is expressed in a flat piston form. This may be of a skinned honeycomb construction for rigidity.

Figure 10C:
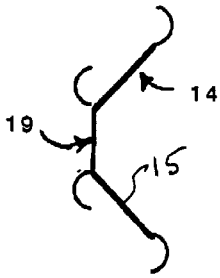
FIG. 10C illustrates a graphic representation of another construction variation of the differential area passive radiator.

FIG. 10C shows a construction of a differential area passive radiator 14, where the small unitary diaphragm area 19 is expressed as a sealed off portion of the smaller open end of conical loudspeaker cone diaphragm 15. This is particularly useful when the lowest mass construction and simplicity is a high priority. The DAPR in FIG. 10C is for use in bandpass loudspeaker where a simplified and/or low mass differential area passive radiator is needed with the system including: an enclosure volume, including at least two chambers; at least one active transducer having first and second sides of a vibratable diaphragm both contained within the enclosure volume; at least one differential area passive radiator comprised of:

a) a single conical diaphragm with a small diameter end and a large diameter end, b) a surround suspension attached to the small diameter end of the conical diaphragm, c) a surround suspension attached to the large diameter end of the conical diaphragm, d) an intermediate wall structure coupled to the small diameter end of the conical diaphragm for sealing off the inside of the conical diaphragm.

Figure 10D:
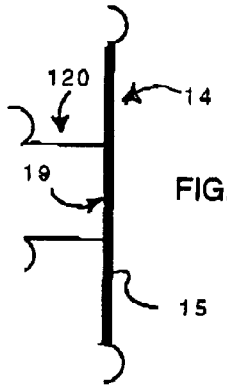
FIG. 10D illustrates a graphic representation of another construction variation of the differential area passive radiator.

FIG. 10D shows a version of the differential area passive radiator 14, with the large primary diaphragm area 15 is substantially the same as FIG. 10B but with the small unitary diaphragm area 19 captured by open cylinder 120.

Figure 10E:
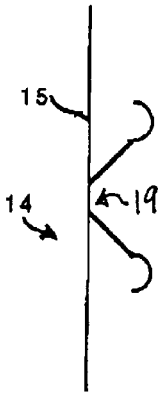
FIG. 10E illustrates a graphic representation of another construction variation of the differential area passive radiator.
Figure 10F:
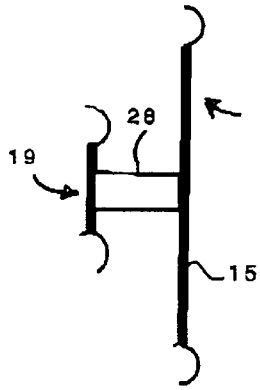
FIG. 10F illustrates a graphic representation of another construction variation of the differential area passive radiator.

FIG. 10E shows a version of the differential area passive radiator 14, with the large primary diaphragm area 15 expressed as a thin film diaphragm such as polyester, polypropylene or Kapton™ film. FIG. 10F shows a version of the differential area passive radiator 14 with the small unitary diaphragm area 19 also being expressed in a flat piston form, the large primary diaphragm 15 expressed as a flat piston form and mechanical connection means 28 joining the two diaphragms together. These diaphragms may be of a skinned honeycomb construction for rigidity.

Figure 10G:
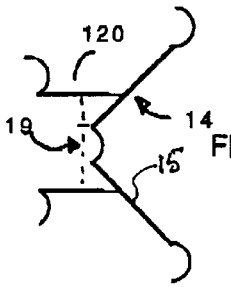
FIG. 10G illustrates a graphic representation of another construction variation of the differential area passive radiator.

FIG. 10G shows a version of the differential area passive radiator 14, with the large primary diaphragm area 15 is substantially the same as FIG. 10A but with the small diaphragm area 19 expressed as an open cylinder.

Figure 10H:
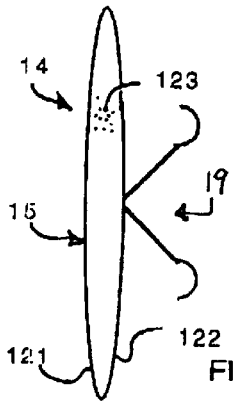
FIG. 10H illustrates a graphic representation of another construction variation of the differential area passive radiator.

FIG. 10H shows a version of the differential area passive radiator 14, similar to that in FIG. 10E with the large diaphragm area 15 using at least two thin films 121 and 122 in parallel and being forcibly separated. The separation may be facilitated by a volume of air 123 trapped inside and sealed off from the outside or by other filler material or structural means.

Figure 11A:
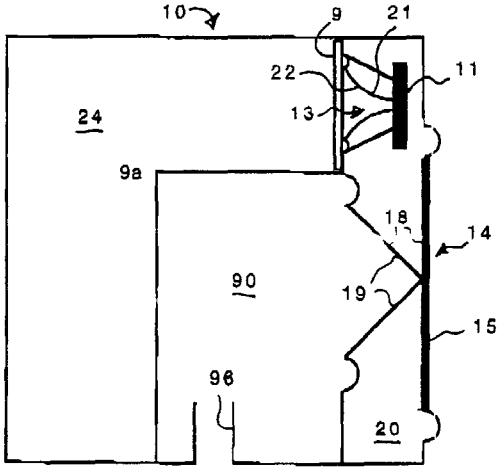
FIG. 11A depicts a graphic representation of the embodiment of FIG. 7A with one port removed.

FIG. 11A shows the parallel driven differential area passive radiator embodiment disclosed in FIG. 7A except without passive acoustic radiator 95 in FIG. 7A, creating a substantially sealed sub enclosure 24 while still maintaining the inventive open architecture by venting the output of acoustic surface area 19 of differential area passive radiator 14 through passive acoustic radiator 96 shown here as an elongated port. This port may be tuned at the upper end or above the passband or alternatively it can be tuned near the lower end of the passband of the bandpass enclosure system 10.

Figure 11B:
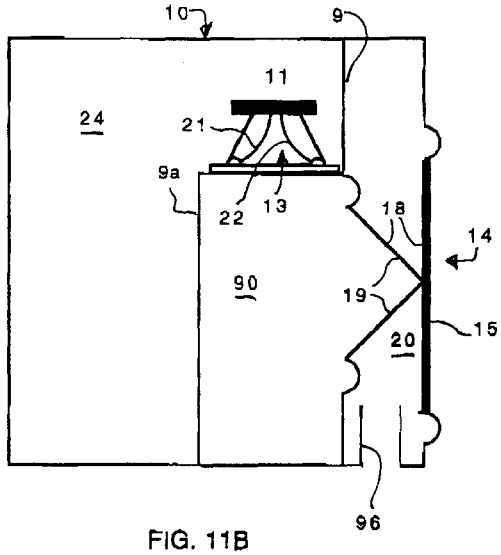
FIG. 11B shows a graphic representation of a functional equivalent to FIG. 11A but of a different configuration.

FIG. 11B is the series driven equivalent of FIG. 11A wherein active transducer 11 is coupled in series through enclosure volume 90 with acoustic surface area 19 of differential area passive radiator 14. Differential surface area 18 of differential area passive radiator 14 is coupled through enclosure volume 20 on through passive acoustic radiator 96, shown here as an elongated port, to the external environment.

Figure 11C:
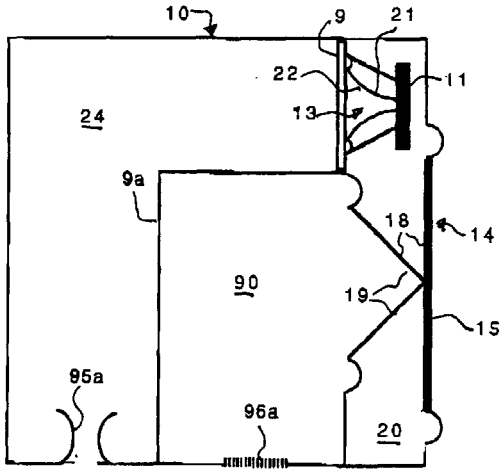
FIG. 11C shows a graphic representation of a functional equivalent to FIG. 7A but with different passive acoustic radiators.

FIG. 11C is the embodiment of FIG. 7A with a different set of passive acoustic radiators. Passive acoustic radiator 95*a* is a flared, low loss port as shown in FIG. 9D. Low loss ports can give the best performance in enclosure volume 24 wherein active transducer 11 operates through this enclosure volume in the manner of a bass reflex system with a port tuning frequency near the low frequency cutoff of the bandpass enclosure system 10. FIG. 11C further illustrates a lossy resistive vent as passive acoustic radiator 96*a*. A lossy vent is used in this location of coupling small unitary diaphragm area 19 of differential area passive radiator 14 through enclosure volume 90 to the external environment. In one approach, this resistive vent 96*a* may be tuned to a frequency at the upper end or above the passband of the bandpass enclosure system 10. This higher frequency tuning of a lossy vent can reduce the effects of stiffness in enclosure volume 20 throughout the passband such that it can be reduced in size for a given performance compared to the sealed off chamber in prior art augmented passive radiator or acoustic lever systems.

An alternative description of FIG. 11C is generally described as a bandpass loudspeaker enclosure system 10 including:

a) at least one electro-acoustic transducer 11 with a vibratable diaphragm 13 having a first acoustical coupling surface 21 and a second acoustical coupling surface 22;

b) at least one differential area passive radiator 14 within the enclosure system having three separate acoustical coupling surface areas including
a small unitary acoustical coupling surface area 19,
a large primary acoustical coupling surface area 15, and
a differential acoustical coupling surface area 18 wherein at least two surfaces areas are of different sizes;

c) the first acoustical coupling surface 21 of the vibratable diaphragm 13 being substantially air coupled through a first enclosure volume 20 to a first of the three separate acoustical coupling surface areas, differential surface area 18 of the at least one differential area passive radiator 14;

d) a second of the three separate acoustical coupling surface areas, small unitary surface area 19 of the at least one differential area passive radiator 14 is substantially air coupled through a second chamber 90 to the external environment through a restricted opening or passive acoustic radiator 96*a* of predetermined characteristics; and e) a third and largest of the three separate acoustical coupling surface areas, primary surface area 15 of said at least one differential area passive radiator 14 acoustically coupled to the external environment;

f) the second acoustical coupling surface 22 of the said vibratable diaphragm being substantially air coupled into a third enclosure volume and ported to the external environment through passive acoustic radiator 95*a*, expressed here as a flared, low loss elongated port.

Figure 11D:
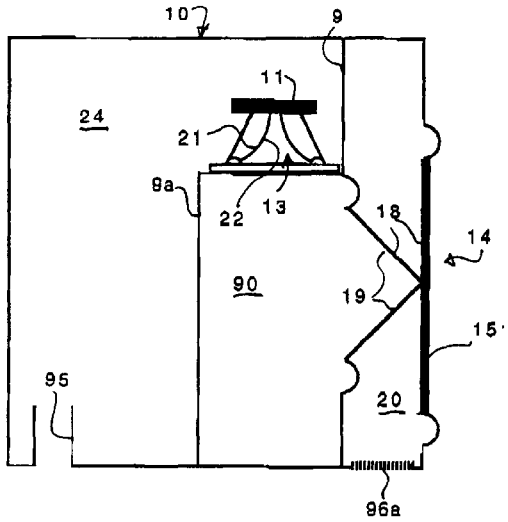
FIG. 11D shows a graphic representation of a functional equivalent to FIG. 11C but of a different configuration.

FIG. 11D is a parallel version of the embodiment in FIG. 11C with the differential area passive radiator 14 now being driven from active transducer 11 by coupling in series with diaphragm surface area 19 of differential area passive radiator 14. Differential surface area 18 in this series version is coupled through enclosure volume 20 to the external environment through passive acoustic radiator 96*a*, shown here as a resistive vent.

The embodiments of FIGS. 11D and 11C may operate with the passive acoustic radiators 95 and 95*a* eliminated as in FIGS. 11A and B.

The differential area passive radiator system is considered to be driven in the parallel mode when the primary coupling between the active transducer 11 and differential area passive radiator 14 is through the small, unitary surface area 19. It is considered to be driven in the parallel mode when the primary coupling from the active transducer 11 is to differential surface area 18 of the differential area passive radiator 14 (or differential area passive radiator 44 in the case of FIGS. 12A and B.)

It has been discovered by the inventor that the parallel mode can offer superior performance due to lower moving mass with available diaphragms when the system ratio through the differential area passive radiator is two to one or less. Relating this to FIG. 11A, a bandpass loudspeaker 10 including at least one differential area passive radiator 14 and at least one active transducer 11 with a vibratable diaphragm 13. The at least one differential area passive radiator 14 includes a small surface area 19, a differential surface area 18 and a large surface area 15. The differential area passive radiator 14 is operated with an acoustic transforming ratio of equal to or less than two to one, meaning that the ratio of the large surface area 15 to the smaller surface area that the diaphragm 13 is coupled to (in this case 18), is equal to or less than two to one. The at least one transducer 11 with said vibratable diaphragm 13 acoustically is coupled through an isolated enclosure volume 20 to the differential surface area 18 of said at least one differential area passive radiator.

Figure 12A:
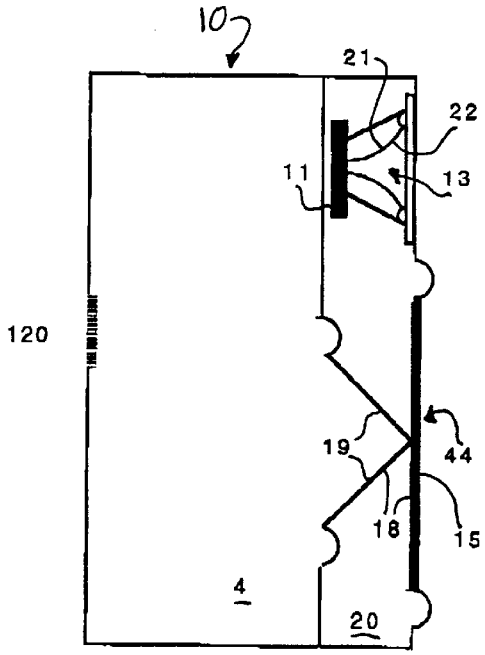
FIG. 12A shows graphic representation of the invention of an improved augmented passive radiator system.

FIG. 12A shows an enhanced, parallel DAPR system utilizing the open architecture of the invention. Enclosure 10 contains sub enclosure volumes 4 and 20 and active transducer 11. Contained between the volumes is a DAPR 44 with three different diaphragm areas, a large primary surface area 15 and a smaller unitary surface area 19 mechanically coupled together and with active transducer 11 interacting with the differential surface area 18 of DAPR 44. As can be seen, the surface area 19 of DAPR 44 is no longer completely sealed into and confined to sealed auxiliary volume 4 due to passive acoustic radiator 120 shown in this embodiment as a lossy vent opening. This lossy vent opening can be tuned to a higher frequency than the resonant frequency of the DAPR and can allow the reduction in size of auxiliary volume 4 while maintaining substantially the same system performance.

Alternatively FIG. 12A can be described as, a loudspeaker enclosure system 10 including:

a) at least one electro-acoustic transducer 11 with a vibratable diaphragm 13 having a first acoustical coupling surface 21 and a second acoustical coupling surface 22;

b) at least one differential area passive radiator 44 within the enclosure system having three separate acoustical coupling surface areas including
a small unitary acoustical coupling surface area 19,
a large primary acoustical coupling surface area 15, and
a differential acoustical coupling surface area 18 wherein at least two surfaces areas are of different sizes;

c) the first acoustical coupling surface area 21 of the said vibratable diaphragm is substantially air coupled through a first enclosure volume 20 to a first of the three separate acoustical coupling surface areas, differential surface area 18 of the differential area passive radiator 44;

d) a second of the three separate acoustical coupling surface areas, the small unitary surface area 19 of the at least one differential area passive radiator 44 is acoustically coupled through a second chamber 4 to the external environment through a restricted opening or passive acoustic radiator 120, shown here as a resistive vent of predetermined characteristics; and e) a third and largest, primary surface area 15 of the three separate acoustical coupling surface areas of the at least one differential area passive radiator 44 is acoustically coupled to the external environment.

When using the passive acoustic radiator or resistive vent tuned to a frequency above that of the resonant frequency or passband of the DAPR it can further improve the performance of the system if the passive acoustic radiator is placed on the far side of the enclosure opposite the differential area passive radiator as illustrated in FIG. 12A.

Figure 12B:
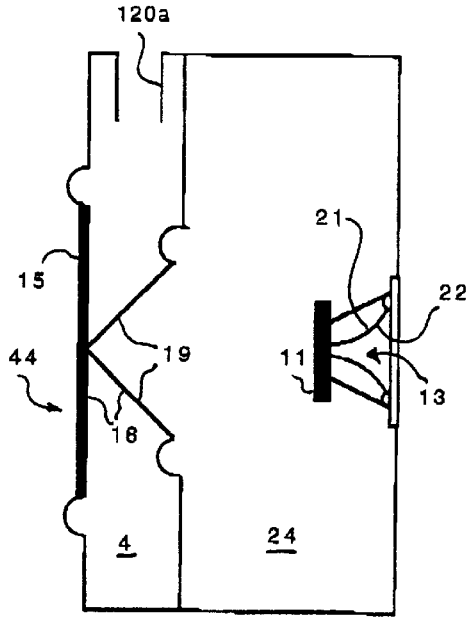
FIG. 12B shows a graphic representation of a functional equivalent to FIG. 12A with a different configuration and passive acoustic radiator.

FIG. 12B shows an enhanced, series DAPR system that performs substantially the same as the one in FIG. 12A with the main difference being that transducer 11 is coupled in series to the small diaphragm area 19 of DAPR 44. Here passive acoustic radiator 120*a,* shown here as an elongated port, vents the acoustical energy from diaphragm area 19 of passive radiator 44 to the external environment. In one version of this embodiment this passive acoustic radiator can be tuned below or above the resonant frequency or passband of the DAPR to further augment output and reduce diaphragm displacement in the passband or to relieve stiffness of auxiliary chamber 4 and therefore allow its volume to be reduced.

Alternatively FIG. 12B can be described as, a loudspeaker enclosure system 10 including:

a) at least one electro-acoustic transducer 11 with a vibratable diaphragm 13 having a first acoustical coupling surface 21 and a second acoustical coupling surface 22;

b) at least one differential area passive radiator 44 within the enclosure system having three separate acoustical coupling surface areas including
a small unitary acoustical coupling surface area 19,
a large primary acoustical coupling surface area 15, and
a differential acoustical coupling surface area 18 wherein at least two surfaces areas are of different sizes;

c) the first acoustical coupling surface area 21 of the said vibratable diaphragm is substantially air coupled through a first enclosure volume 24 to a first of the three separate acoustical coupling surface areas 19 of the differential area passive radiator 44;

d) a second of the three separate acoustical coupling surface areas 18 of the at least one differential area passive radiator 44 is acoustically coupled through a second chamber 4 to the external environment through a restricted opening or passive acoustic radiator 120*a,* shown here as an elongated port of predetermined characteristics; and e) a third and largest primary surface area 15 of the three separate acoustical coupling surface areas of the at least one differential area passive radiator 44 is acoustically coupled to the external environment.

Both FIGS. 12A and 12B can substitute any of the passive acoustic radiators in FIGS. 9A to 9G for the illustrated passive acoustic radiators 120 and 121.

Also, both FIGS. 12A and 12B can be considered closed architecture, augmented passive radiator systems that have been significantly improved by converting them to an open architecture, differential area passive radiator system by opening up auxiliary chamber 4 with a passive acoustic radiator.

Figure 13A:
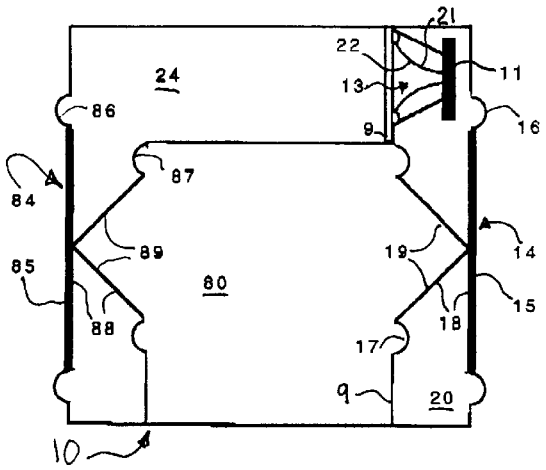
FIG. 13A shows the invention with each surface of the transducer coupled to a separate differential area passive radiator and each differential area passive radiator coupled to the other differential area passive radiator.

FIG. 13A shows a bandpass loudspeaker enclosure system 10 incorporating primary enclosure volume 20, primary enclosure volume 24, and primary enclosure volume 80. Dividing wall 9 is positioned between primary enclosure volumes 20 and 24. Electro-acoustic transducer 11 is mounted on dividing wall 9 and includes movable diaphragm 13 which has surface area side 21 and a surface area side 22. The surface area side 21 of movable diaphragm 13 communicates into primary enclosure volume 20 and surface area side 22 of movable diaphragm 13 communicates into primary enclosure volume 24. There are first and second differential area passive radiators 14 and 84 which include large primary diaphragm surface areas 15 and 85 and two secondary diaphragm surface areas smaller in acoustic coupling area than the primary diaphragm surface areas. The secondary diaphragm surface areas include small unitary diaphragm surface areas 19 and 89 and differential diaphragm surface areas 18 and 88. The primary diaphragm surface areas 15 and 85 are interconnected to unitary diaphragm surface areas 19 and 89 and include peripheral attachment means 16, 17, 86, and 87.

The differential diaphragm surface area 18 is defined by the differential surface area established between primary diaphragm surface area 15 peripheral attachment means 16 and secondary diaphragm surface area peripheral attachment means 17. The differential diaphragm surface area 88 is defined by the differential surface area established between primary diaphragm surface area 85, peripheral attachment means 86, and secondary diaphragm surface area peripheral attachment means 87. The surface area side 21 of electro-acoustic transducer 11 is pneumatically coupled through primary enclosure volume 20 to differential diaphragm surface area 18 of DAPR 14. The surface area side 22 of electro-acoustical transducer 11 is pneumatically coupled through primary enclosure volume 24 to differential diaphragm surface area 88 of second DAPR 84. The unitary diaphragm surface area 19 of differential area passive radiator 14 and the unitary diaphragm surface area 89 of differential area passive radiator 84 are pneumatically coupled to each other through primary enclosure volume 80. The primary diaphragm surface areas 15 and 85 of first and second differential area passive radiators 14 and 84 have one surface area side communicating outside of all three primary enclosure volumes 20, 24, and 80.

Figure 13B:
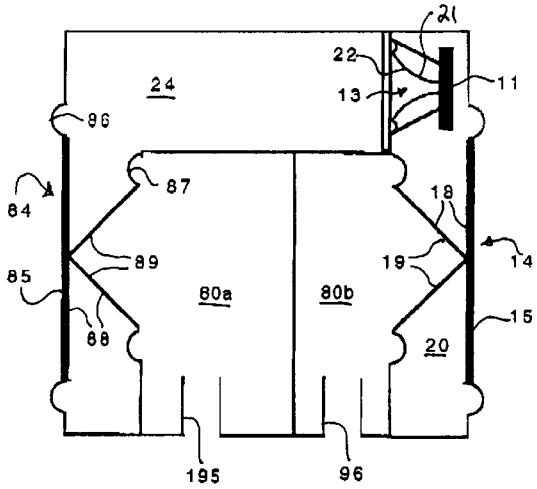
FIG. 13B shows a graphic representation of the invention with one surface of the transducer coupled to a differential area passive radiator and the other to an augmented passive radiator.

FIG. 13B is a bandpass loudspeaker enclosure system 10 including:

a) at least one electro-acoustic transducer 11 with a vibratable diaphragm 13 which has a first acoustical coupling surface 21 and a second acoustical coupling surface 22;

b) at least one differential area passive radiator 14 within the enclosure system having three separate acoustical coupling surface areas including
   a small unitary acoustical coupling surface area 19,
   a large primary acoustical coupling surface area 15, and
   a differential acoustical coupling surface area 18 wherein at least two surfaces areas are of different sizes;

c) the first acoustical coupling surface 21 of the vibratable diaphragm 13 being substantially air coupled through a first enclosure volume 20 to a first 18 of the three separate acoustical coupling surface areas of said at least one differential area passive radiator 14;

d) a second, small unitary surface area 19 of the three separate acoustical coupling surface areas of the at least one DAPR 14 is acoustically coupled into a second chamber 80*b* and from the second chamber to the external environment through at least a first passive acoustic radiator 96 of predetermined acoustical characteristics; and e) a third and largest of the three separate acoustical coupling surface areas, primary surface area 15 of said at least one differential area passive radiator 14 acoustically coupled to the external environment;

f) said second acoustical coupling surface 22 of the said vibratable diaphragm 13 substantially air coupled into a third enclosure volume 24. The at least a first passive acoustic radiator 96 has a predetermined characteristic of acoustic mass. The third enclosure volume 24 is coupled to an augmented passive radiator 84 differential surface area 88 with one surface area 89 coupled to a fourth enclosure volume 80*a*. Second surface area 88 of augmented passive radiator 84 is coupled to vibratable diaphragm surface side 22. Large diaphragm surface area 85 of the augmented passive radiator 84 is coupled to the external environment. The small diaphragm surface area 89 of differential area passive radiator 84 is coupled through enclosure volume 80*a* to the external environment through passive acoustic radiator 195. Passive acoustic radiator 96 can be tuned above the passband of the bandpass system 10 allowing reduction of the size of chamber 80*b*. Passive acoustic radiator 195 can be tuned above the passband of the bandpass system 10 allowing reduction of the size of chamber 80*a*. Both passive acoustic radiators may also be tuned in or near the lower end of the passband to increase the acoustic output of the system. There may also be a mixture of tuning one higher and the other lower with the passive acoustic radiator 96 usually being tuned to the higher of the two frequencies.

If chamber 80*a* were to remain sealed without passive acoustic radiator 195, then 84 would operate as a closed architecture augmented passive radiator. By opening the chamber 80*a* to the external environment with passive acoustic radiator 195 this portion of the system is "converted" to an open architecture differential area passive radiator.

Figure 13C:
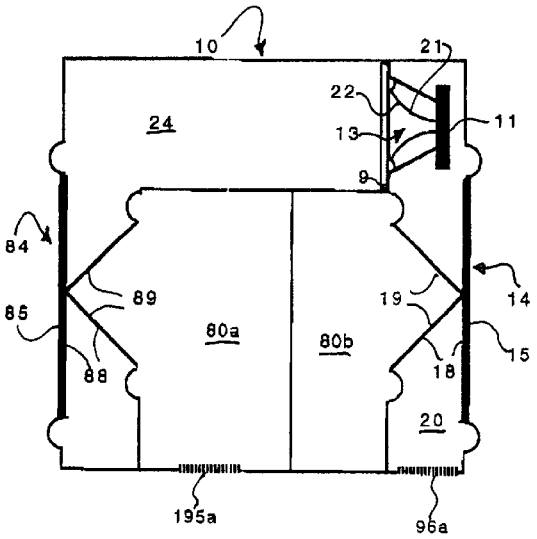
FIG. 13C shows a graphic representation of a functional equivalent to FIG. 13B but with different passive acoustic radiators.

FIG. 13C is essentially the same configuration as that of FIG. 13B with the exception of passive acoustic radiators 195*a* and 96*a* both being shown as lossy vents with a predetermined dominant characteristic of acoustic resistivity. The passive acoustic radiators of FIGS. 13B and C may be mixed and matched differently or any known passive acoustic radiator including those from FIGS. 9A to 9G may be utilized. Also, passive acoustic radiators 195 and 195*a* can be omitted as in FIG. 13A.

If chamber 80*a* were to remain sealed without passive acoustic radiator 195*a* then 84 would operate as a closed architecture augmented passive radiator. By opening the chamber 80*a* to the external environment with passive acoustic radiator 195*a,* including an acoustically resistive characteristic, this portion of the system is "converted" to an open architecture differential area passive radiator.

Figure 13D:
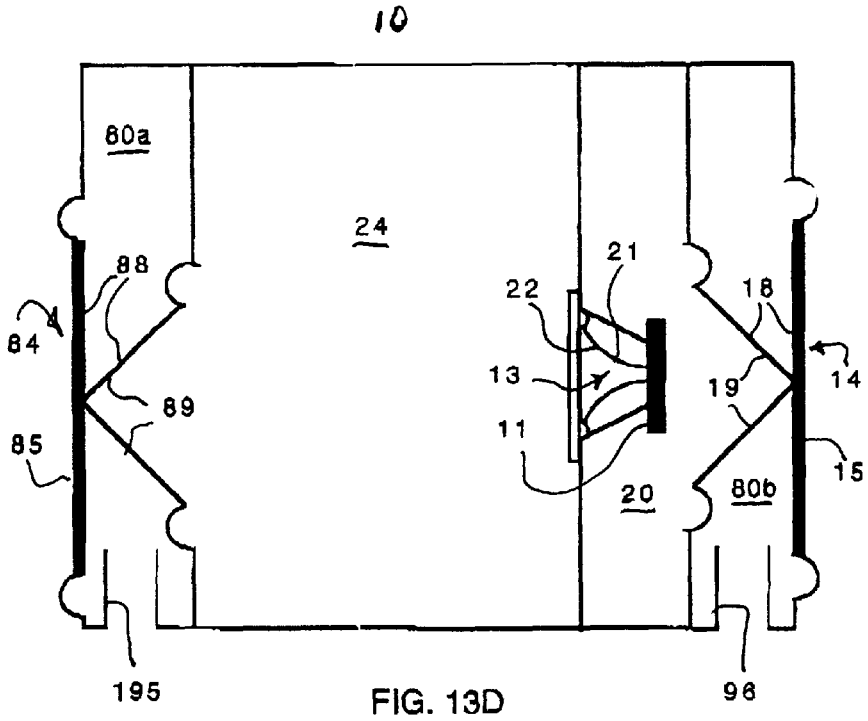
FIG. 13D shows a graphic representation of a functional equivalent to FIG. 13B but of a different configuration.

FIG. 13D is a series version of FIG. 13B illustrating a bandpass loudspeaker enclosure system 10 including:

a) at least one electro-acoustic transducer 11 with a vibratable diaphragm 13 having a first acoustical coupling surface 21 and a second acoustical coupling surface 22;

b) at least one differential area passive radiator 14 within the enclosure system having three separate acoustical coupling surface areas including
   a small unitary acoustical coupling surface area 19,
   a large primary acoustical coupling surface area 15, and a differential acoustical coupling surface area 18 wherein at least two surfaces areas are of different sizes;

c) the first acoustical coupling surface 21 of the vibratable diaphragm 13 being substantially air coupled through a first enclosure volume 20 to a first, smaller unitary surface area 19 of the three separate acoustical coupling surface areas of said at least one differential area passive radiator 14;

d) a second 18 of the three separate acoustical coupling surface areas of the at least one differential area passive radiator 14 acoustically coupled into a second chamber 80*b* and from the second chamber to the external environment through at least a first passive acoustic radiator 96 of predetermined characteristics; and e) a third and largest of the three separate acoustical coupling surface areas 15 of said at least one differential area passive radiator 14 acoustically coupled to the external environment;

f) said second acoustical coupling surface 22 of the said vibratable diaphragm 13 being substantially air coupled into a third enclosure volume 24. The at least a first passive acoustic radiator 96 has a predetermined characteristic of acoustic mass. The third enclosure volume 24 is coupled to an DAPR 84 a first small unitary surface area 89 with one surface area 88 coupled to a fourth enclosure volume 80*a*. Second surface area, small unitary surface area 89 of DAPR 84 is coupled to vibratable diaphragm surface side 22. Large diaphragm surface area 85 of the DAPR 84 is coupled to the external environment. The small unitary diaphragm surface area 89 of differential area passive radiator 84 is coupled through enclosure volume 80*a* to the external environment through passive acoustic radiator 195. In one preferred embodiment passive acoustic radiator 96 can be tuned above the passband of the bandpass system 10. In one preferred embodiment passive acoustic radiator 195 can be tuned above the passband of the bandpass system 10.

If chamber 80*a* were to remain sealed without passive acoustic radiator 195, then 84 would operate as a closed architecture augmented passive radiator. By opening the chamber 80*a* to the external environment with passive acoustic radiator 195 this portion of the system is "converted" to an open architecture differential area passive radiator.

Figure 13E:
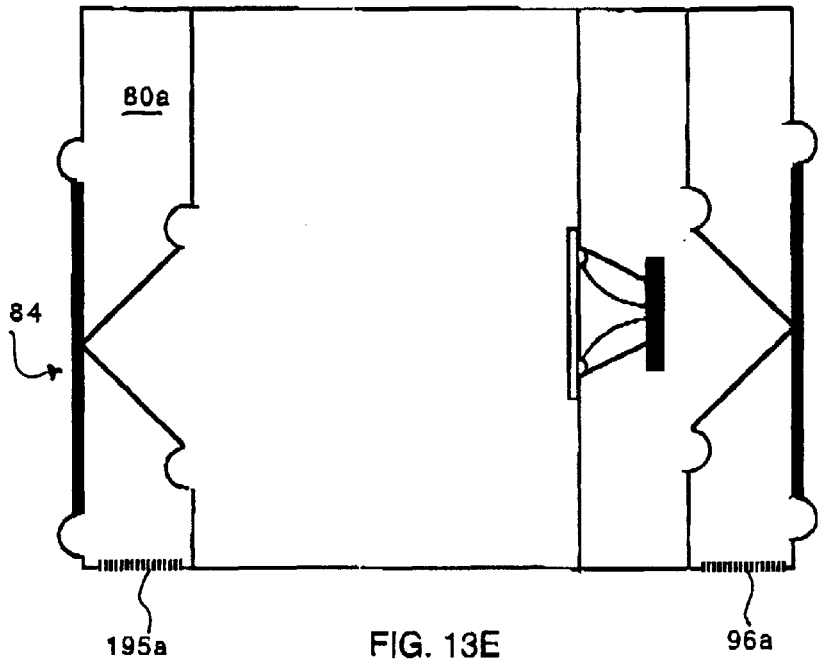
FIG. 13E shows a graphic representation of a functional equivalent to FIG. 13D but with different passive acoustic radiators.

FIG. 13E is essentially the same configuration as that of FIG. 13D with the exception of passive acoustic radiators 195*a* and 96*a* both being lossy vents with a dominant acoustically resistive characteristic. The passive acoustic radiators of FIGS. 13D and E may be mixed and matched differently or any passive acoustic radiator may be utilized including those from FIGS. 9A to 9G. Also, passive acoustic radiator 195*a* can be omitted while the invented system will maintain superior performance to that of the fully closed architecture prior art systems.

If chamber 80*a* were to remain sealed without passive acoustic radiator 195, then back to back passive cone structure 84 would operate as a closed architecture augmented passive radiator. By opening the chamber 80*a* to the external environment with passive acoustic radiator 195*a*, this portion of the system is "converted" to an open architecture differential area passive radiator.

Figure 13F:
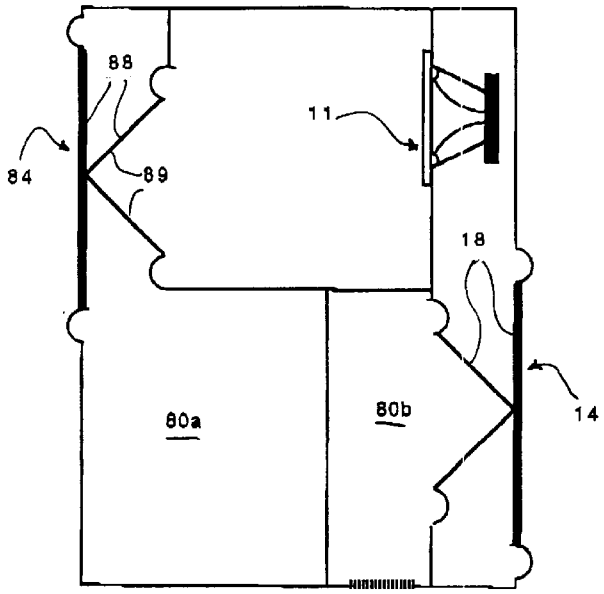
FIG. 13F shows a graphic representation of a functional equivalent to FIG. 13B but of a different configuration.

FIGS. 13F and G are a mixture of the attributes of 13B, C, D, and E. 13F is a parallel/series hybrid with transducer 11 driving differential diaphragm 18 of differential area passive radiator 14 in parallel mode with transducer 11 driving small unitary diaphragm surface 89 of augmented passive radiator 84 in series mode. Item 89 operating as an augmented passive radiator due to the closed architecture of auxiliary chamber 80*a*. Another way to view FIG. 13F is that of being equivalent of FIG. 11C except for the substitution of an augmented passive radiator 84 as a substitute passive acoustic radiator for passive acoustic radiator 95*a* in FIG. 11C. The augmented passive radiator includes the fourth chamber 80*a* as its auxiliary sealed chamber.

Figure 13G:
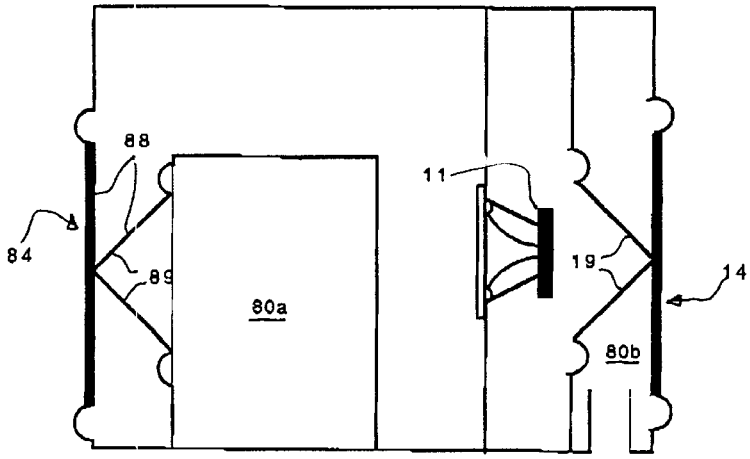
FIG. 13G shows a graphic representation of a functional equivalent to FIG. 13F but of a different configuration.

FIG. 13G is and equivalent system but just the inverse of FIG. 13F with transducer 11 driving small unitary diaphragm surface 19 of open architecture, differential area passive radiator 14 in series mode and transducer 11 driving differential diaphragm surface 88 of closed architecture augmented passive radiator 84 in parallel mode.

Figure 14A:
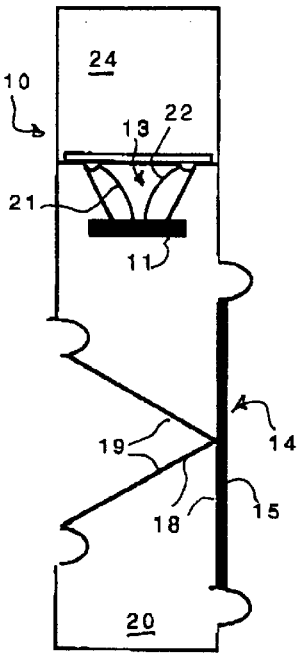
FIG. 14A shows a graphic representation of a parallel, two chamber open architecture embodiment of the invention.

FIG. 14A is another embodiment of the open architecture bandpass invention which consists of a bandpass loudspeaker enclosure system 10 including:

a) a total of two chambers 20 and 24 within the enclosure system;

b) at least one electro-acoustic transducer 11 within the enclosure system 10 having a vibratable diaphragm 13 with a first acoustical coupling surface 21 and a second acoustical coupling surface 22;

c) at least one differential area passive radiator 14 within the enclosure system 10 having three separate acoustical coupling surface areas including:
a small unitary acoustical coupling surface area 19,
a large primary acoustical coupling surface area 15, and
a differential acoustical coupling surface area 18;

d) a first acoustical coupling surface 21 of the said vibratable diaphragm 13 being substantially air coupled through the first chamber 20 to a first of the three separate acoustical coupling surface areas, the differential acoustical coupling surface 18, of said at least one differential area passive radiator 14, and e) a second of the three separate acoustical coupling surface areas, the small unitary acoustical coupling surface area 19 of said at least one differential area passive radiator 14 being acoustically coupled to the external environment, f) a third and largest of the three separate acoustical coupling surface areas, the primary acoustical coupling surface area 15, of said at least one differential area passive radiator 14 acoustically coupled to the external environment, g) said second acoustical coupling surface 22 of the said vibratable diaphragm 13 being substantially air coupled into the second chamber 24.

In this parallel embodiment of the bandpass loudspeaker enclosure 10 system of FIG. 14A the first of three separate acoustical coupling surface areas of the differential area passive radiator 14, which is the one acoustically coupled to the transducer diaphragm 13, is the differential acoustical coupling surface area 18.

Figure 14B:
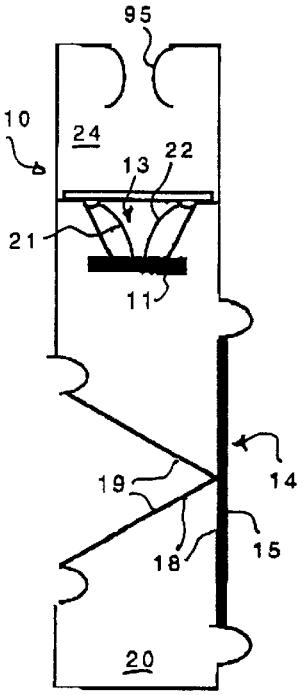
FIG. 14B shows a graphic representation of a version of FIG. 14A further including a passive acoustic radiator.

FIG. 14B is essentially the same as that of FIG. 14A with the further addition of passive acoustic radiator 95 exiting chamber 24 to the external environment.

Figure 15A:
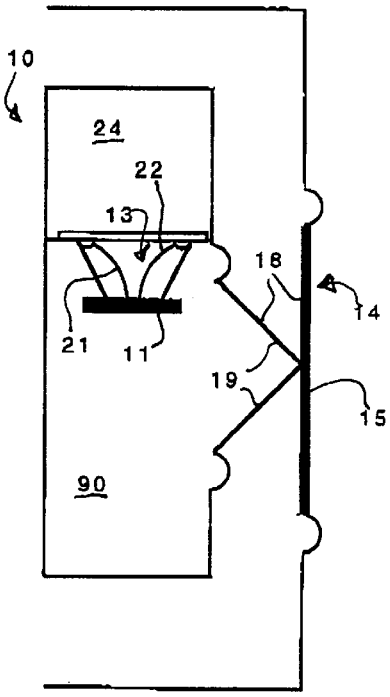
FIG. 15A shows a graphic representation of a series, two chamber open architecture embodiment of the invention.

FIG. 15A is the series equivalent of the parallel version of the bandpass loudspeaker enclosure system in FIG. 14A with entails a bandpass loudspeaker enclosure system 10 including:

a) a total of two chambers 90 and 24 within the enclosure system;

b) at least one electro-acoustic transducer 11 within the enclosure system 10 having a vibratable diaphragm 13 with a first acoustical coupling surface 21 and a second acoustical coupling surface 22;

c) at least one differential area passive radiator 14 within the enclosure system 10 having three separate acoustical coupling surface areas including
a small unitary acoustical coupling surface area 19,
a large primary acoustical coupling surface area 15, and
a differential acoustical coupling surface area 18;

d) a first acoustical coupling surface 21 of the said vibratable diaphragm 13 being substantially air coupled through the first chamber 90 to a first of the three separate acoustical coupling surface areas, the small unitary acoustical coupling surface 19, of said at least one differential area passive radiator 14, and e) a second of the three separate acoustical coupling surface areas, the differential acoustical coupling surface area 18 of said at least one differential area passive radiator 14 being acoustically coupled to the external environment, f) a third and largest of the three separate acoustical coupling surface areas, the primary acoustical coupling surface area 15, of said at least one differential area passive radiator 14 acoustically coupled to the external environment, g) said second acoustical coupling surface 22 of the said vibratable diaphragm 13 being substantially air coupled into the second chamber 24.

In this series embodiment of the bandpass loudspeaker enclosure 10 system of FIG. 15A the first of three separate acoustical coupling surface areas of the differential area passive radiator 14, which is the one acoustically coupled to the transducer diaphragm 13, is the small unitary acoustical coupling surface area 18.

Figure 15B:
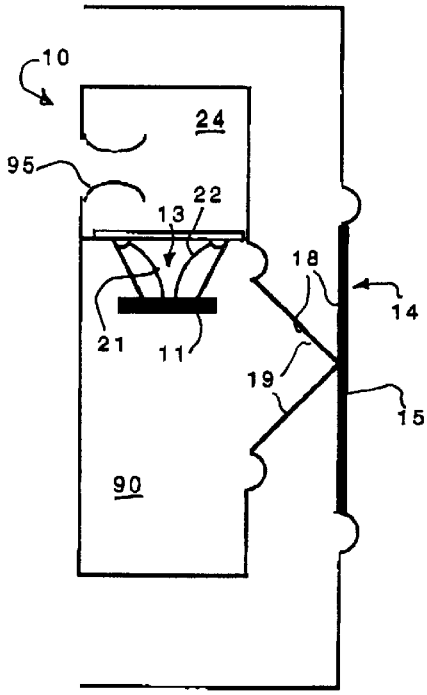
FIG. 15B shows a graphic representation of a version of FIG. 15A further including a passive acoustic radiator.

FIG. 15B is essentially the same as that of FIG. 14A with the further addition of passive acoustic radiator 95 exiting chamber 24 to the external environment.

Figure 16A:
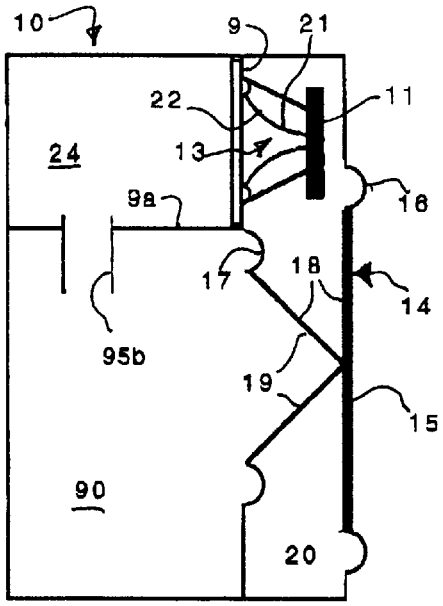
FIG. 16A shows a graphic representation of the invention with open architecture intercoupled chambers.

FIG. 16A is that of a bandpass loudspeaker enclosure system 10 including:

a) at least one electro-acoustic transducer 11 with a vibratable diaphragm 13 having a first acoustical coupling surface 21 and a second acoustical coupling surface 22;

b) at least one differential area passive radiator 14 with three separate acoustical coupling surface areas, the largest, large primary acoustical coupling surface area 15, the differential area acoustical coupling surface area 18, and the small unitary acoustical coupling surface area 19;

c) the first acoustical coupling surface 21 of the said vibratable diaphragm 13 substantially air coupled through a first enclosure volume 20 to a first of the three separate acoustical coupling surface areas, here in the parallel case, differential surface area 18 of said at least one differential area passive radiator 14;

d) illustrating the novel open architecture aspect of this embodiment, a second of the three separate acoustical coupling surface areas, small unitary surface area 19 of said at least one differential area passive radiator 14 being substantially air coupled through a second chamber 90 to third chamber 24 through an acoustic opening of predetermined dimensions or passive acoustic radiator 95*b* of predetermined characteristics. Opening 95*b* is shown here as an elongated port but can be of any passive acoustic radiator construction known in the art including those in FIGS. 9A to 9G; and e) a third and largest of the three separate acoustical coupling surface areas, large primary acoustical coupling area 15 of said at least one differential area passive radiator 14 acoustically coupled to the external environment;

f) again, illustrating the novel open architecture aspect of this embodiment, said second acoustical coupling surface of the said vibratable diaphragm substantially air coupled into a third enclosure volume 24 and acoustically intercoupled through passive acoustic radiator 95*b* into chamber 90.

When operated in the parallel mode, structure of FIG. 16A may be preferred when the differential area passive radiator ratio is less than two to one due to lower DAPR mass for all ratios less than two to one. When the differential area passive radiator ratio is greater than two to one then the series version of FIG. 16A, shown in FIG. 16B may be preferred due to lower DAPR mass for all ratios greater than two to one.

Figure 16B:
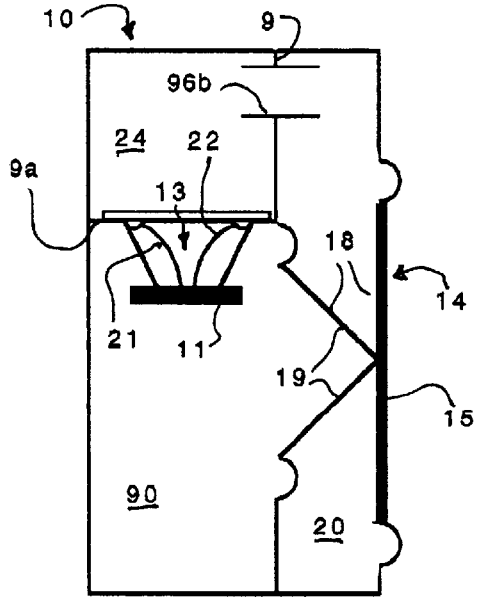
FIG. 16B shows a graphic representation of the invention with an alternative construction to the system in FIG. 16A.

FIG. 16B shows an equivalent but alternative version of the embodiment of FIG. 16A. Shown is bandpass loudspeaker system 10 including:

a) at least one electro-acoustic transducer 11 with a vibratable diaphragm 13 having a first acoustical coupling surface 21 and a second acoustical coupling surface 22;

b) at least one differential area passive radiator 14 with three separate acoustical coupling surface areas, the largest, large primary acoustical coupling surface area 15, the differential area acoustical coupling surface area 18, and the small unitary acoustical coupling surface area 19;

c) the first acoustical coupling surface 21 of the said vibratable diaphragm 13 being substantially air coupled through a first enclosure volume 90 to a first of the three separate acoustical coupling surface areas, small unitary surface area 19 of said at least one differential area passive radiator 14;

d) a second of the three separate acoustical coupling surface areas, differential surface area 18 of said at least one differential area passive radiator 14 is substantially air coupled through a second chamber 20 to a third chamber 24 through an acoustic opening of predetermined dimensions or passive acoustic radiator of predetermined characteristics 96*b*. Passive acoustic radiator 96*b* is shown here as an elongated port but can be of any passive acoustic radiator construction known in the art including those in FIGS. 9*a* to 9*g;* and e) a third and largest of the three separate acoustical coupling surface areas, primary surface area 15 of said at least one differential area passive radiator 14 acoustically coupled to the external environment;

f) said second acoustical coupling surface 22 of the said vibratable diaphragm being substantially air coupled into a third chamber 24 and acoustically intercoupled through passive acoustic radiator 96*b* into chamber 20. Restricted acoustic opening or passive acoustic radiator 95, shown here as an elongated port, couples the output of side 22 of diaphragm 13 to the external environment. Passive acoustic radiator 95 can be of any passive acoustic radiator construction known in the art including those in FIGS. 9*a* to 9*g*.

All of the attributes of this embodiment are essentially the same as that of FIG. 16A except for the preference of when this configuration is operated in a series mode being preferable in systems using greater than two to one DAPR transformation ratios.

Many further variations will be obvious to one skilled in the art such as the type of diaphragm structures that can be used in all areas of diaphragm use. For example the diaphragms can be composed of a thin film, loudspeaker cones, a flat panel or other diaphragms used in the loudspeaker art. These may also be mixed between any of the diaphragm types and forms. Any of the chambers in the enclosure systems may or may not have acoustic absorption material placed inside them. Active transducers used in the systems described can be used in many orientations to achieve the equivalent result. Ratios of diaphragms, volumes and tunings can cover a broad range to achieve the desired result with the invention. Many prior art systems can be incorporated into the invention to create hybrids from systems known in the art such as Isobarik types, push-pull, negative spring systems and others known to one skilled in the art. Many substitutions for the passive acoustic energy radiator are known in the art such as various versions of vents or ports, that can be either straight or flared, and also various versions of what are known as passive radiators, drone cones or auxiliary bass radiators. As is shown there are also many variations of constructions that can realize the performance of the component specified in the invention as the A differential area passive radiator. These can be standard loudspeaker cones, or any object with a surface area that can be pneumatically driven in the manner taught by the invention. It should also be obvious to the skilled in the are that the main enclosure 10 can take what ever form required to establish the bounding surfaces of the specified sub enclosures and chambers.

It is evident that those skilled in the art may now make numerous other modification of and departures from the specific apparatus and techniques herein disclosed without departing from the inventive concepts. Consequently, the invention is to be construed as embracing each and every novel feature and novel combination of features present in or possessed by the apparatus and techniques herein disclosed and limited solely by the spirit and scope of the appended claims.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and filly described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A loudspeaker enclosure system including:

a) a total of first and second chambers within the enclosure system;

b) at least one electro-acoustic transducer with a vibratable diaphragm having a first acoustical coupling surface and a second acoustical coupling surface;

c) at least one differential area passive radiator within the enclosure system having three separate acoustical coupling surface areas including
a small unitary acoustical coupling surface area,
a large primary acoustical coupling surface area, and
a differential acoustical coupling surface area, d) said first acoustical coupling surface of the said vibratable diaphragm being substantially air coupled through the first chamber to a first of the three separate acoustical coupling surface areas of said at least one differential area passive radiator; and e) a second of the three separate acoustical coupling surface areas of said at least one differential area passive radiator acoustically being coupled into the second chamber and from said second chamber to the external environment through at least a first opening of predetermined dimensions;

f) a third primary acoustical coupling surface area of the three separate acoustical coupling surface areas of said at least one differential area passive radiator being acoustically coupled to the external environment.

2. The loudspeaker enclosure system of claim 1 wherein said opening of predetermined dimensions is at least a first passive acoustic radiator.

3. The loudspeaker enclosure system of claim 2 wherein said first of three separate acoustical coupling surfaces of said differential area passive radiator is the differential surface area of said differential area passive radiator.

4. The loudspeaker enclosure system of claim 2 wherein said first of three separate acoustical coupling surfaces of said differential area passive radiator is the small unitary surface area of said differential area passive radiator.

5. The loudspeaker enclosure system of claim 2 wherein said passive acoustic radiator has a predetermined characteristic of acoustic resistance.

6. The loudspeaker enclosure system of claim 2 wherein said passive acoustic radiator has a predetermined characteristic of acoustic mass.

7. A method for enhancing the output of at least one differential area passive radiator operating over a passband of frequencies and having at least three acoustic surface areas, including at least two surface areas of differing size, mounted in a loudspeaker enclosure including the steps of:

a) acoustically coupling a first side surface of a diaphragm of an active transducer through a first chamber to an acoustically isolated first acoustic surface area of at least one differential area passive radiator;

b) acoustically coupling a second acoustic surface area of the differential area passive radiator to a second chamber and on through at least one opening of predetermined dimensions to the external environment;

c) coupling a third and largest acoustic surface area of the differential area passive radiator to the external environment.

8. The method of claim 7 further including the step of:

d) configuring the opening of predetermined dimensions as a passive acoustic radiator.

9. The method of claim 8 further including the step of:

e) tuning the passive acoustic radiator to a frequency above the passband of the differential area passive radiator.

10. The method of claim 8 further including the step of:

e) tuning the passive acoustic radiator to a frequency in the passband of the differential area passive radiator.

11. The method of claim 8 further including the step of:

e) tuning the passive acoustic radiator to a frequency below the passband of the differential area passive radiator.

12. The method of claim 7 further including the step of:

d) adding the characteristic of acoustic resistance to the opening of predetermined dimensions.

13. A bandpass loudspeaker enclosure system including:

a) at least a first, second and third chamber within the enclosure system;

b) at least one electro-acoustic transducer within the enclosure system having a vibratable diaphragm with a first acoustical coupling surface and a second acoustical coupling surface;

c) at least one differential area passive radiator within the enclosure system having three separate acoustical coupling surface areas including
a small unitary acoustical coupling surface area,
a large primary acoustical coupling surface area, and
a differential acoustical coupling surface area;

d) said first acoustical coupling surface of the said vibratable diaphragm being substantially air coupled through the first chamber to a first of the three separate acoustical coupling surface areas of said at least one differential area passive radiator; and e) second of the three separate acoustical coupling surface areas of said at least one differential area passive radiator acoustically coupled into the second chamber and from said second chamber to the external environment through at least a first opening of predetermined dimensions, f) a third and largest of the three separate acoustical coupling surface areas of said at least one differential area passive radiator acoustically coupled to the external environment, g) said second acoustical coupling surface of the said vibratable diaphragm substantially air coupled into the third chamber.

14. The bandpass loudspeaker enclosure system of claim 13 wherein; the at least a first opening of predetermined dimensions is at least a first passive acoustic radiator.

15. The bandpass loudspeaker enclosure system of claim 14 wherein said at least a first passive acoustic radiator has a predetermined acoustic resistance.

16. The bandpass loudspeaker of claim 13 wherein said first of three separate acoustical coupling surfaces of said differential area passive radiator is the differential surface area of said differential area passive radiator.

17. The bandpass loudspeaker of claim 13 wherein said first of three separate acoustical coupling surfaces of said differential area passive radiator is the small unitary surface area of said differential area passive radiator.

18. The bandpass loudspeaker enclosure system of claim 14 wherein said at least a first passive acoustic radiator has a predetermined characteristic of acoustic mass.

19. The bandpass loudspeaker enclosure system of claim 14 wherein said third chamber enclosure volume is coupled to the external environment through at least a second passive acoustic radiator and said second passive acoustic radiator has a predetermined characteristic of acoustic mass.

20. The bandpass loudspeaker enclosure system of claim 19 wherein said at least a second passive acoustic radiator is an augmented passive radiator.

21. The bandpass loudspeaker enclosure system of claim 20 further comprising a fourth chamber in communication with said augmented passive radiator.

22. The bandpass loudspeaker enclosure system of claim 21 wherein said fourth chamber is coupled to the external environment through an additional passive acoustic radiator converting the closed architecture augmented passive radiator to an open architecture differential area passive radiator.

23. The bandpass loudspeaker enclosure system of claim 14 wherein the at least a first passive acoustic radiator is tuned to a frequency above the passband frequency range of the bandpass loudspeaker system.

24. The bandpass loudspeaker enclosure of claim 14 wherein the first passive acoustic radiator is tuned to a frequency in the pass band of the bandpass loudspeaker system.

25. The bandpass loudspeaker enclosure of claim 14 wherein the first passive acoustic radiator is tuned to a frequency below the pass band of the bandpass loudspeaker system.

26. The bandpass loudspeaker enclosure system of claim 22 wherein the additional passive acoustic radiator coupling said fourth enclosure volume to the external environment is tuned to a frequency above the resonant frequency of the differential area passive radiator.

27. The bandpass loudspeaker enclosure system of claim 22 wherein the additional passive acoustic radiator coupling said fourth enclosure volume to the external environment is tuned to a frequency at or below the resonant frequency of the differential area passive radiator.

28. The bandpass loudspeaker enclosure system of claim 22 wherein the additional passive acoustic radiator coupling said fourth enclosure volume to the external environment has the characteristic of acoustic resistance.

29. A bandpass loudspeaker enclosure system including:

a) at least a first, second and third chamber within the enclosure system;

b) at least one electro-acoustic transducer within the enclosure system having a vibratable diaphragm with a first acoustical coupling surface and a second acoustical coupling surface;

c) at least one differential area passive radiator within the enclosure system having three separate acoustical coupling surface areas including
a small unitary acoustical coupling surface area,
a large primary acoustical coupling surface area, and
a differential acoustical coupling surface area;

d) said first acoustical coupling surface of the said vibratable diaphragm being substantially air coupled through the first chamber to a first of the three separate acoustical coupling surface areas of said at least one differential area passive radiator; and e) second of the three separate acoustical coupling surface areas of said at least one differential area passive radiator acoustically coupled into the second chamber and from said second chamber the third through at least a first opening of predetermined dimensions, f) a third and largest of the three separate acoustical coupling surface areas of said at least one differential area passive radiator acoustically coupled to the external environment, g) said second acoustical coupling surface of the said vibratable diaphragm substantially air coupled into the third chamber.

30. The bandpass loudspeaker enclosure system of claim 29 wherein; the at least a first opening of predetermined dimensions is at least a first passive acoustic radiator.

31. The bandpass loudspeaker enclosure system of claim 30 wherein said at least a first passive acoustic radiator has a predetermined acoustic resistance.

32. The bandpass loudspeaker of claim 29 wherein said first of three separate acoustical coupling surfaces of said differential area passive radiator is the differential surface area of said differential area passive radiator.

33. The bandpass loudspeaker of claim 29 wherein said first of three separate acoustical coupling surfaces of said differential area passive radiator is the small unitary surface area of said differential area passive radiator.

* * * * *